US008184134B2

(12) United States Patent
Asao et al.

(10) Patent No.: US 8,184,134 B2
(45) **Date of Patent: *May 22, 2012**

(54) DISPLAY APPARATUS

(75) Inventors: Yasufumi Asao, Atsugi (JP); Hideo Mori, Yokohama (JP); Kohei Nagayama, Sagamihara (JP); Hironao Tanaka, Yamato (JP); Ryuichiro Isobe, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 748 days.

This patent is subject to a terminal disclaimer.

(21) Appl. No.: 12/255,010

(22) Filed: Oct. 21, 2008

(65) Prior Publication Data

US 2009/0046107 A1 Feb. 19, 2009

Related U.S. Application Data

(60) Division of application No. 11/171,235, filed on Jul. 1, 2005, now Pat. No. 7,460,115, which is a continuation of application No. PCT/JP2005/009213, filed on May 13, 2005.

(30) Foreign Application Priority Data

May 14, 2004 (JP) ..... 2004-145726

(51) Int. Cl.
*G09G 5/10* (2006.01)

(52) U.S. Cl. ..... 345/690; 345/87; 345/88; 345/204

(58) Field of Classification Search ..... 345/72, 345/77, 83–84, 87–90, 92, 204, 214, 589, 345/591–593, 596–597, 690, 698–699; 348/30, 70–71

See application file for complete search history.

(56) References Cited

U.S. PATENT DOCUMENTS

| | | | | |
|---|---|---|---|---|
| 6,014,195 | A | 1/2000 | Sakamoto et al. | 349/96 |
| 6,147,728 | A | 11/2000 | Okumura et al. | 349/106 |
| 7,030,553 | B2 * | 4/2006 | Winters et al. | 313/504 |
| 7,110,001 | B2 * | 9/2006 | Sasaki | 345/590 |
| 7,218,298 | B2 * | 5/2007 | Yamazaki et al. | 345/83 |
| 7,460,115 | B2 * | 12/2008 | Asao et al. | 345/204 |
| 7,495,679 | B2 * | 2/2009 | Chou | 345/690 |
| 7,688,408 | B2 * | 3/2010 | Murai | 349/114 |
| 7,697,012 | B2 * | 4/2010 | Lee et al. | 345/613 |
| 7,893,892 | B2 * | 2/2011 | Tamura et al. | 345/76 |
| 2001/0004296 | A1 | 6/2001 | Van Aerle et al. | 359/254 |
| 2004/0222999 | A1 * | 11/2004 | Choi et al. | 345/589 |
| 2006/0012614 | A1 | 1/2006 | Asao et al. | 345/690 |
| 2006/0028495 | A1 * | 2/2006 | Phan | 345/694 |

(Continued)

FOREIGN PATENT DOCUMENTS

JP 2846317 12/1989

(Continued)

*Primary Examiner* — Nitin Patel
*Assistant Examiner* — Mansour M Said
(74) *Attorney, Agent, or Firm* — Fitzpatrick, Cella, Harper & Scinto

(57) ABSTRACT

A display apparatus includes a display portion and a control portion, and effects color display depending on image signals for three colors. The control portion includes means 10, into which the image signals for three colors are inputted, for generating a first display signal for determining a brightness of predetermined one color at the display portion and second display signals for determining a hue of other two colors or an intermediary color therebetween at the display portion.

5 Claims, 25 Drawing Sheets

U.S. PATENT DOCUMENTS

2006/0170712 A1* 8/2006 Miller et al. ..... 345/695

FOREIGN PATENT DOCUMENTS

| | | |
|---|---|---|
| JP | 2837913 | 12/1991 |
| JP | 06-062417 | 3/1994 |
| JP | 07-034127 | 2/1995 |
| JP | 07-069548 | 3/1995 |
| JP | 09-084037 | 3/1997 |
| JP | 09-113868 | 5/1997 |
| JP | 09-244046 | 9/1997 |
| JP | 2001-272956 | 10/2001 |
| JP | 2003-195284 | 7/2003 |
| JP | 2005-031265 | 2/2005 |

* cited by examiner

PRIOR ART

DISPLAY APPARATUS

RELATED APPLICATIONS

This application is a divisional of patent A.N. 11/171,235, filed Jul. 1, 2005, which is a continuation of PCT application PCT/JP2005/0009213, filed May 13, 2005. This application claims the benefit of the filing dates of those applications under 35 U.S.C. §120, and claims priority benefit under 35 U.S.C. §119 of Japanese patent application no. 145726/2004, filed May 14, 2004. The entire disclosure of each of the mentioned three prior applications is incorporated herein by reference.

BACKGROUND OF THE INVENTION

Field of the Invention

Technical Field

The present invention relates to a display apparatus effecting color display depending on image signals for three colors.

Heretofore, there has been known a display apparatus which effects color display depending on three types of signals, corresponding to images of three colors, red, green and blue. In such a display apparatus, a display device such as a CRT, plasma display (PDP), organic EL display (OLED), or liquid crystal display constitutes a display portion, and a control circuit serves for sending a signal thereto. Into the control circuit, respective pieces of image information of the three primary colors are inputted as three signals, where they are subjected to appropriate signal processing so as to be suitable for the display portion to use to generate display signals.

In broadcast wave or information transmission between video equipment, a composite video signal comprising mixed pieces of RGB information is generally used. The composite video signal cannot be displayed as it is at the display portion comprising the above described display device, and so the control circuit includes a circuit for converting the composite video signal into an RGB signal, a circuit for performing various signal conditionings such as gamma correction with respect to the converted RGB signal, and a circuit for converting the conditioned signal into a display signal suitable for the display device.

Incidentally, hereinafter, three means, viz., (1) means for inputting RGB signals, (2) signal conditioning means, and (3) means for outputting color display signals to the display device, and information signal transmission means between these means are collectively referred to as a display system.

In the CRT, an electron beam emitted from an electron gun is changed in direction by a deflection yoke, and by this means the electron beam is controlled so as to scan a display surface. At the display surface, fluorescent materials of RGB are disposed and each of the fluorescent materials corresponding to pixels is irradiated with the electron beam in a point-sequential manner, whereby the fluorescent material of a desired change is caused to emit light. Brightness is controlled by adjusting an intensity of the irradiation electron beam, so that it becomes possible to effect full-color display. Accordingly, in order to control intensities of three electron beams applied to the fluorescent materials, respectively, the display system outputs serially the three types display signals for RGB.

In the PDP, full-color display is effected by modulating an emission intensity or an emission time of three types of fluorescent materials for RGB disposed in a pixel. The display system converts RGB image signals into emission intensity signals for time-division display timing. These signals are sent to the display portion at a predetermined timing to provide display signals at the pixel where the fluorescent materials for RGB are disposed.

As a color display method of the OLED, (1) a method wherein luminescent layers of three types of RGB are applied at subpixels, respectively, (2) a method wherein color filters of three colors of RGB are disposed on an OLED layer emitting white light, and (3) a method wherein a display color is converted into a display color different from emission color of an OLED layer by a color conversion material and taken out of the display device, have been known. In either case, in order to effect full-color display, three types of subpixels for RGB are disposed in a unit pixel and a display signal corresponding to an emission intensity is applied for each subpixel.

In the LCD, there are some color display modes but in an ordinary well-known mode, subpixels provided with color filters of three colors of RGB constitute one pixel. At each of the subpixels, the transmittance of a liquid crystal is continuously modulated to effect full-color display.

As an liquid crystal projector, there are a single-plate method using the LCD and a three-plate method using three LCDs. In either case, a display system generates three display signals for RGB and sends the display signals to the LCD in the single-plate method and separately to the three LCDs, respectively, in the three-plate method.

As the display system in the above described OLED and LCD, a circuit for outputting input image signals as three types of display signals corresponding to respective subpixels for RGB is required.

This circuit is shown in FIG. 23. Into a display system 10, information signals for three colors of RGB are inputted, and output signals for displaying three colors of RGB adopted to a display device are generated. The input signals and output signals can be respectively analog signals or digital signals. This circuit includes a circuit for converting the analog signals to the digital signals (and vice versa), γ (gamma) correction circuit, a dithering circuit for display halftone at a plurality of pixels, and the like, as desired.

The display systems for RGB is further divided into a plurality of subpixels in some cases. By dividing one subpixel into two portions at an areal ratio of 2:1, it is possible to effect display of digital areal gradation at four levels. In such a case, the output signals from the display system 10 provide six signal lines consisting of two signal lines for each of the colors RGB.

In order to enhance light utilization efficiency, there has been also proposed a display device including a color display unit of four colors RGBW which are constituted by adding white (W) to the RGB. The display system in this case also has a function of generating a W signal from the input signals for RGB.

There has also been well known a color display using a three-complementary-color system of yellow (Y), magenta (M), and cyan (C). Two methods of this type include (1) an additive color mixture method using YMC color filters, instead of ordinary RGB color filters, and (2) a subtractive color mixture method, wherein respective display layers of YMC are laminated to effect color display.

In the YMC three-complementary-color system, image signals for the RGB three primary colors are converted into three signals for YMC. At this time, in order to effect full-color display with good color reproducibility, it is necessary to output YMC information by making an adjustment. The adjustment is made so as to effect natural display by utilizing a look-up table or the like.

As the color LCD, in addition to this display device, there is an LCD of field sequential type utilizing color mixture by time division. A full-color LCD of this type sequentially displays three pieces of display information, for the colors RGB, on a liquid crystal panel in a time division manner and turns a backlight for RGB on and off in synchronism with each display. By performing a time-division display cycle at a sufficiently high speed, additive color mixture is made by an afterimage effect of a viewer's eyes, so that the image is seen as a color image. The display system in this case serially outputs inputted image signals for RGB in a time division manner while reducing a signal period to ⅓.

As described above, in the conventional display systems for color display including that of natural pictures, in many cases, a control circuit portion outputs three independent color signals for RGB (or YMC), and the display portion effects display of various colors by combining these color signals.

A combination of colors can be readily understood by considering it with the use of a color solid. With respect to the color solid, representation systems of various types have been proposed and may, e.g., include the Munsell system, the Ostwald system, the L*a*b* system, the L*u*v* system, the RGB system, and the like. However, in any representation system, colors present in nature are represented by a three-dimensional solid or a two-dimensional plane while fixing one coordinate. These coordinate systems can be converted to each other. Hereinbelow, explanation will be made by using the RGB system.

A color solid of the RGB system is shown in FIG. 24. Respective edges of the cube shown in FIG. 24 are coordinate axes of respective colors RGB.

Any of the above described display apparatuses, such as the CRT, the PDP, the LCD, and the like, effects full-color display by independently controlling respective display colors of RGB and combining the display colors. When this is represented in the RGB color solid, magnitudes of three independent vectors constituting the RGB color solid with black (Bk) as an origin are controlled to effect full-color display. When the display color is determined by the additive color mixture of RGB, a composite vector of the three vectors provides a resultant display color. If magnitudes of the three vectors can be continuously and variably changed, it is possible to extensively display an arbitrary color.

In the case wherein any of the three independent vectors cannot be continuously changed, however, the result is an area in the color solid that cannot be displayed. In such a case, it is impossible to effect full-color display of a natural picture or the like. In many cases, such a limitation is caused to occur by a constraint of the display device.

Incidentally, as the color (display) method of the LCD, a display method which utilizes a coloring phenomenon by birefringence and does not use a color filter has been proposed in U.S. Pat. No. 6,014,195 and U.S. Patent Application Publication No. 2001/004296A1.

This display method is capable of displaying the three primary colors without using a color filter, so that there are merits in realizing a high light utilization efficiency and brightness display at low cost.

An interference color by birefringence causes a continuous brightness change of an achromatic color in a low retardation area and a continuous hue change of a chromatic color in a high retardation area. In the chromatic color area, the brightness cannot be changed, so that full-color display cannot be effected to result in multi-color display.

A display system in this case captures only a brightness signal from input RGB signals and outputs the brightness signal in the case of displaying the achromatic color, and captures a hue signal of a composite color from the input RGB signals and supplies a voltage of retardation corresponding to the hue as a display signal in the case of displaying the chromatic color.

In an existing display apparatus of a type in which a display color is determined by the additive color mixture of the RGB primary colors, the three vectors which are parallel to the respective edges of the color solid are independently controlled, so that the resultant or sum of those vectors thereof provides a display color.

However, in color display utilizing birefringence, a displayable color is limited to a color on one curved line in the color solid. When the retardation is 0, Bk is displayed. When the retardation is increased, brightness is increased at an initial stage while the achromatic color is retained as it is, so that the display point moves from Bk toward W along a diagonal line of the color solid. After the display point reaches W, when the retardation is further increased, a chromatic color appears and is changed in the order yellow, red, magenta, blue, . . . , so that a locus thereof is one curved line in the color solid.

The range of displayable color is limited as described above, so that a color which is not on the curved line cannot be reproduced. This is an explanation, by the color solid, of why an intermediary brightness of a chromatic color cannot be displayed in the above described color display device using birefringence.

Display of halftone by dividing a pixel into a plurality of subpixels can also be effected in a birefringence color display device. In the above described prior art document (U.S. Pat. No. 6,014,195), an embodiment in which a subpixel for displaying birefringence color and a subpixel for displaying an achromatic color are combined is described.

In this case, at one subpixel, any one of chromatic colors is displayed by birefringence and the subpixel is combined with a subpixel for displaying achromatic color. Depending on the brightness of the achromatic color pixel, the color purity of the entire pixel is determined.

However, it is not easy to determine a signal supplied to the respective subpixels in this case. The three input image signals for RGB represent coordinates in the color solid, respectively. However, the coordinate points are not necessarily located on a curved line determined by the above described locus of birefringence. Further, even when the coordinate points are extended, they do not always intersect with the above-described curved line. This poses a difficulty in determining a hue coordinate of the subpixel for displaying the chromatic color (i.e., a color coordinate, along the above described curved line, which can also be replaced by retardation) and a brightness coordinate of the subpixel for displaying the achromatic color (a ratio of display brightness to maximum brightness). This is because when an extended line of the coordinate points intersects with the above-described curved line, the hue coordinate is determined from the intersection point but when the extended line does not intersect with the curved line, there is no intersection point, so that the hue coordinate and the brightness coordinate cannot be determined.

As described above, in the birefringence color display, it is not clear how to assign signals with respect to the respective pixels in order to display a point off of the curved line determined by the locus of birefringence color drawn in the color solid. For this reason, there has arisen a difficulty in optimally designing the display system.

SUMMARY OF THE INVENTION

Accordingly, the present invention has been accomplished in view of these circumstances, and an object of the present invention is to provide a color display apparatus capable of effecting natural picture display.

The present invention is a display apparatus, comprising: a display portion and a control portion, said display apparatus effecting color display depending on image signals for three colors.

The control portion comprises means, into which the image signals for three colors are inputted, for generating a first display signal for determining a brightness of one, predetermined color at the display portion and second display signals for determining a hue of the other two colors or an intermediary color therebetween at the display portion.

As in the present invention, by processing three inputted types of image signals for red, green and blue, the first output signal, for displaying the predetermined one color, and the second output signal, for displaying the other two colors, are produced, and these first output signal and second output signal are outputted to a display device which effects color display, so that it becomes possible to effect natural picture display without using three independent color output signals.

BEST MODE FOR CARRYING TO THE INVENTION

Hereinbelow, the inventors' best mode for carrying out the present invention will be described in detail with reference to the drawings.

Figure 1:
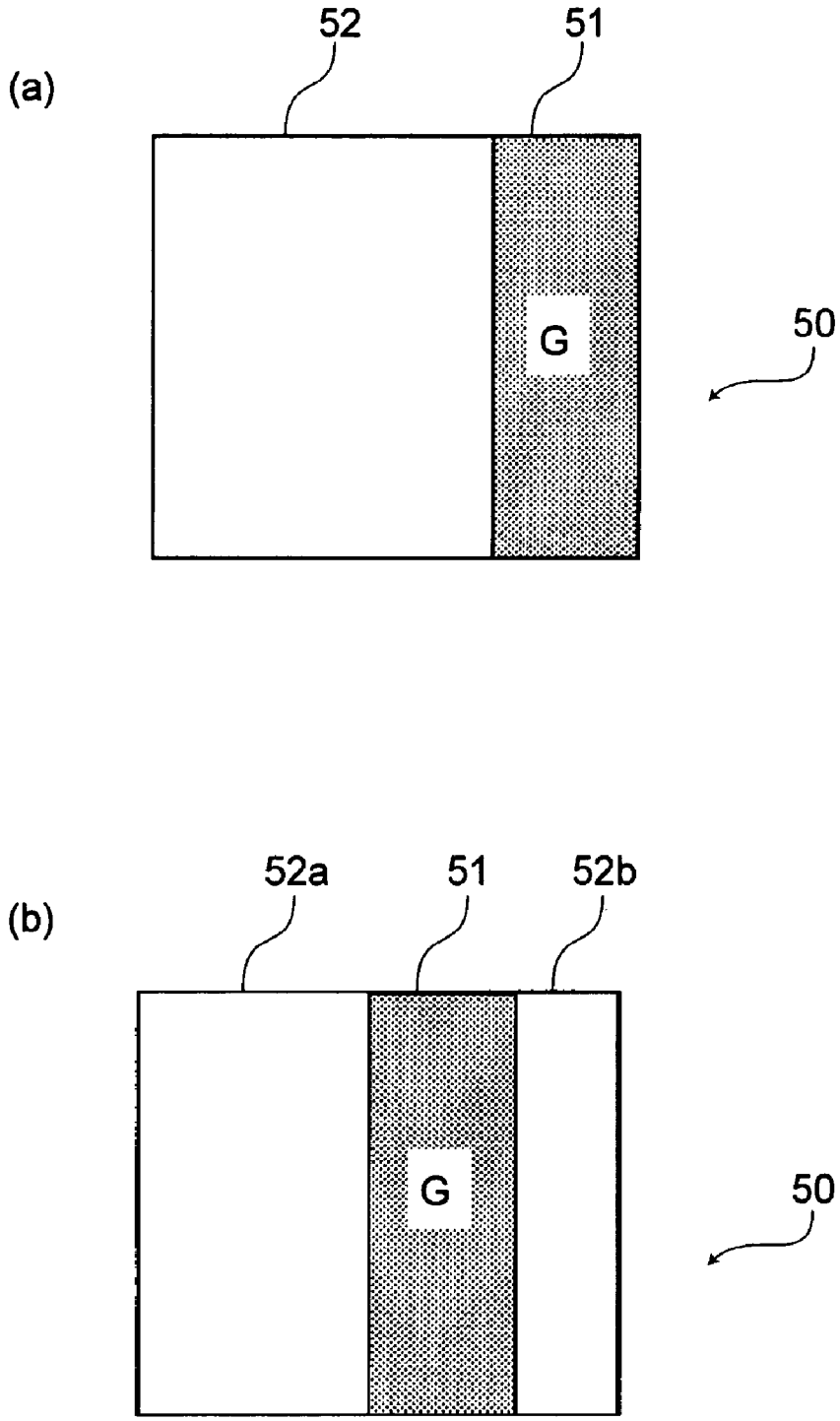
FIGS. 1(*a*) and 1(*b*) are views showing the structure of one pixel of a liquid crystal display device (color display device) used in a color display apparatus according to a best mode for carrying out the present invention.

FIGS. 1(*a*) and 1(*b*) are views showing a structure of one pixel of a color display device used in a color display apparatus according to the best mode for carrying out the present invention. Next, the color display operation principle of this color display device will be described. Incidentally, to the color display device used in the present invention, those of various modes are applicable, but the display principle thereof will be described while taking a liquid crystal display device using a liquid crystal having an ECB effect as an example.

In the liquid crystal display device (color display device) usable in the present invention, as shown in FIG. 1(*a*), one pixel 50 is divided into a plurality (two) of subpixels 51 and 52, and one subpixel 51 is provided with a green color filter represented by G and at the other subpixel 52, by adjusting a retardation of a liquid crystal layer thereof voltage application, a change in brightness of an achromatic color from black to white and display of any color from red to blue through green are achieved.

More specifically, a unit pixel is constituted by a first subpixel 51, at which chromatic color is displayed by changing the retardation of the liquid crystal layer under voltage application, and a second subpixel 52, at which a green color filter is provided and the color (green) of the color filter is displayed by changing the retardation in a brightness change range through voltage. In short, at the subpixel 51 for displaying green having a high luminosity factor (hereinafter, referred to as a "green subpixel"), the green color filter G is used without utilizing an ECB effect-based coloring phenomenon, which is utilized only for red and blue.

By virtue of the thus-constituted unit pixel, e.g., the green subpixel 51 provided with the color filter is placed in the dark state and the subpixel 52 provided with no color filter (hereinafter, referred to as a "transparent subpixel") is placed in the white state (a maximum brightness state in a change area of achromatic color), whereby it is possible to display white at the pixel as a whole.

Further, it is also possible to place the green subpixel 51 in a maximum transmission state and place the transparent subpixel 52 in a magenta (display) state in the chromatic color area. The magenta includes both red (R) and blue (B), so that it is possible to attain white display as the result of color composition.

In order to effect the single color display of green (G), the green subpixel 51 is placed in the maximum transmission state and the transparent subpixel 52 is placed in the dark state. In order to effect the single color display of red (R) (or blue (B)), the green subpixel 51 is placed in the dark state and the transparent pixel 52 is adjusted to provide a retardation value of 450 nm (or 600 nm). Further, using the above methods in combination, it is also possible to obtain mixed color of R and G or B and G.

Further, at both the G subpixel 51 and the transparent subpixel 52, it is needless to say that black display can be effected by providing these pixels with a retardation of zero to be placed in the dark state. Incidentally, the retardation referred to herein is an amount of the retardation itself of the liquid crystal layer in the case where the subpixels are used in a transmission type, and in the case where the subpixels are used in a reflection type, light passes through the liquid layer two times, so that a value obtained by doubling the retardation amount of the liquid crystal layer is used.

Further, in this construction, at the green subpixel 51, the retardation is changed in the range of 0-250 nm, and at the transparent subpixel 52, the retardation is changed both in the range of 0-250 nm and the range of 450-600 nm. At both the subpixels 51 and 52, the liquid crystal material is ordinarily used in common, so that a drive voltage range is set to be different as between the sub-pixels.

Here, as a result of selecting the green color filter, production of green by the adjustment of retardation can be avoided, which means that it is not necessary to increase the cell thickness. Further, green has a high luminosity factor, so that image quality is improved by producing a high-purity color by means of the color filter.

Further, as described above, when the construction is such that green is displayed by means of the color filter and other colors are displayed by colors produced by a medium (the liquid crystal in the above-described case) itself, the construction is applicable to display devices other than the liquid crystal type of display device. In other words, generally, when a medium which changes an optical property under the control of externally applied modulation means is used and the medium exhibits a modulation area changing a blue by the modulation means and a modulation area changing a hue by the modulation means, the present invention is applicable thereto.

In this case, according to calculation, a retardation for red display is 450 nm and a retardation for blue display is 600 nm. Accordingly, the cell thickness may be set so as to realize the retardation of 600 nm. In the above described embodiment, in the case of using a general VA mode (vertical alignment mode) of a transmission-type, the cell thickness may be about 10 microns. When the cell thickness is of this magnitude, it becomes possible to effect motion picture display, although some blurring occurs.

Further, in the case where this construction is applied to a reflection-type liquid crystal display device, the cell thickness is halved, so that the response speed is of the order of that of a transmission type LCD which is currently commercially available. As a result, the response speed can be such at a level that it presents no problem with respect to motion picture display, also. Further, a color reproduction range of red is determined by the color filter and the luminosity factor is high, so that it becomes possible to realize a high color reproducibility without sacrificing the transmittance of a white component.

Incidentally, in the liquid crystal display device shown in FIG. 1(*a*), with respect to the green subpixel 51 having a high luminosity factor, it is possible to effect the continuous gradation display. However, the transparent subpixel 52 utilizes the chromatic color state, i.e., the coloring by the ECB effect, so that the gradation display cannot be effected. For this reason, in order to improve this point, as shown in FIG. 1(*b*), the transparent subpixel 52 is divided into plural portions (N portions), i.e., two subpixels 52*a* and 52*b* in the figure and the same time, an areal ratio therebetween is changed to represent gradation in a digital manner. Here, the subpixels 52*a* and 52*b* have different areas, so that halftones at some levels are displayed depending on the areas of the subpixels at which lighting is performed to display a color. For example, it is possible to obtain a gradation display characteristic with high linearity by dividing the transparent subpixel 52 into N portions of at an area ratio of $1:2:\ldots:2^{N-1}$.

Here, in the liquid crystal display device according to this construction, the digital gradation is used only for red and blue, which have a low luminosity characteristic. This is because at the green subpixel 51, it is possible to display a continuous gradation by performing a continuous modulation in the range from 0 to 250 nm. By virtue of this, the gradation is not perceived by a human's eyes as being greatly impaired, so that a relatively good color image can be obtained. In other words, the digital gradation is employed only for red and blue, which have a smaller number of gradations perceivable by the eyes, whereby it becomes possible to provide a sufficient characteristic even when the number of gradation levels is limited.

Incidentally, in order to provide the sufficient gradation characteristic even at the limited gradation levels as described above, a pixel pitch may preferably be small. More specifically, from the viewpoint of such a resolution that a human cannot recognize the pixel, the pixel pitch may preferably be not more than 200 μm.

Further, when the pixel pitch is small one, it becomes possible to effect good natural picture display by using dithering even in a case where the gradation display is not necessarily effected by performing area division into a unit subpixel. In this case, only two pixels are required as unit subpixels for display of the three primary colors, thus being advantageous also for provision of a high definition display device. Further, in this instance, when a degree of definition is equal to that of the conventional-type display device, the number of channels of a column signal driver is reduced to ⅔, so that the definition degree can contribute to a reduction in costs.

As described above, the liquid crystal display device of this constitution adopts the display method utilizing the ECB ("effect-based color") phenomenon with respect to red and blue, so that it is not necessary to use a color filter. As a result, it is possible to remarkably reduce a loss of light as compared with the case of respective color filters of red and blue.

As a result, as its applied embodiment, it is possible to provide a display device with a higher light utilization efficiency than that of the case of the conventional method, where the three primary colors are displayed only by the RGB color filters. As a result, the liquid crystal display device of the present constitution can be used as the reflection-type liquid crystal display device for paper-like display or electronic paper.

On the other hand, even in the case of using the liquid crystal display device of this constitution as the transmission-type liquid crystal display device, the transmittance of the liquid crystal layer is high, so that the power consumption of the backlight that is required to provide the same brightness as in the conventional one is low. Thus, the transmission-type liquid crystal display device may suitably be used from the viewpoint of low power consumption.

Further, the liquid crystal display device of this construction has a high liquid crystal responsiveness, thus being also usable for motion picture display. Conventionally, with respect to the liquid crystal display device used for the television purpose, there has been proposed, in Japanese Laid-Open Patent Application No. 2001-272956, etc., a driving method, called a "pseudo-impulse drive", in which a shutoff period for the backlight is provided in one frame period in order to realize a clear motion picture characteristic, but there arises a problem that the brightness is lowered by an amount corresponding to the shutoff period of the backlight. However, even for such a purpose, by applying the display device having a high response speed and a high transmittance as in the liquid crystal display device of the present invention, that problem can be solved.

Further, the display device of the present invention may also be suitably applicable to a projection-type display device requiring a high light utilization efficiency.

Further, in the above-described embodiment, analog gradation is realized by the color filter with respect to gradation display, and digital gradation is realized, during display of red and blue, by utilization of the coloring phenomenon based on the ECB effect and the display method based on the pixel division method with respect to red and blue.

On the other hand, in the reflection-type liquid crystal display device as described above, there are also uses requiring a high transmittance and more display colors. Further, in the transmission-type liquid crystal display device capable of effecting full-color display, there have also been a requirement with respect to a high-transmittance display mode in order to suppress the power consumption of the backlight while retaining a full-color display performance. In addition thereto, there are many requirements with respect to such a display mode capable of effecting full-color display with high light utilization efficiency.

Herein, in order to meet the above-described requirements, on the basis of the constitution described above, there are further methods (schemes) capable of effecting multi-color display) shown below:

(1) a method in which the coloring phenomenon based on the ECB effect is also utilized at a retardation values other than those for red and blue, (2) a method in which continuous gradation color in a low retardation range at the pixel provided with the color filter of color complementary to green is utilized, and (3) a method in which a pixel provided with color filters for either or both of green and blue is added.

(1) Method Utilizing ECB (Effect-Based Coloring) Phenomenon at Retardation Values Other Than Those for Red and Blue.

Figure 2:
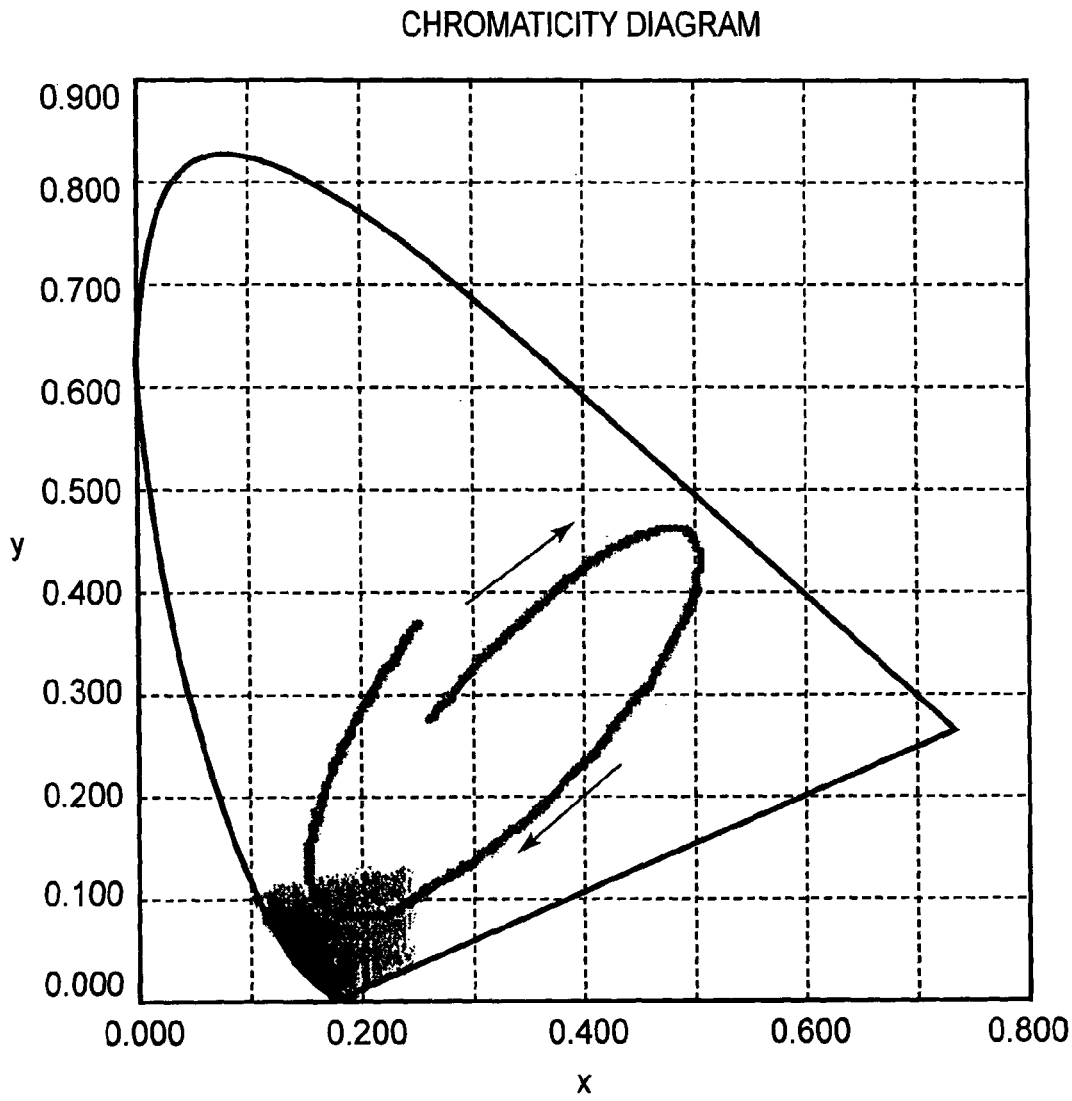
FIG. 2 is a diagram showing a hue change at the time of retardation change of the above-described liquid crystal display device.

In the above-described embodiment, the principle of effecting the display of red and blue by utilizing the coloring phenomenon on the basis of the ECB effect is described, but in this coloring phenomenon based on the ECB effect, as shown in FIG. 2, it is possible to change the hue continuously from white to blue. More specifically, there are many available display colors other than red and blue described above. By using such display colors, it becomes possible to represent a larger number of display colors than those described above.

More specifically, a change in display color under a cross-nicol condition in such a construction that the first subpixel 52 (FIG. 2) is not provided with the color filter will be described. As shown by the arrows in FIG. 2, a change in brightness of achromatic color such that the display state is changed from the black state to the white state via the gray (halftone) state with an increase in brightness from zero is caused to occur. Further, in a retardation range exceeding the white range, it is possible continuously to change various chromatic colors as in the order yellow, yellowish red, red, reddish violet, violet, bluish violet, and blue.

Further, by combining the achromatic color range with the green pixel, it is also possible to effect bright green display. Incidentally, by combining the colors in the chromatic color range with the green pixel, an intermediary color can be displayed. Further, with respect to the resultant chromatic colors, similarly as in the case of red and blue, it becomes possible to represent the digital gradation by the above-described constitution. By this means, it is possible to represent many more display colors.

(2) Method Utilizing Continuous Gradation Color in Low Retardation Range at Pixel Provided with Color Filter of Color Complementary to Green.

In the case where the first sub-pixel is not provided with the color filter as in the above described basic construction shown in FIG. 1 or Method (1), in a retardation amount range exceeding the white range, such a change in hue in the order of yellow, yellowish red, red, reddish violet (magenta), violet, bluish violet, and blue is achieved. In this embodiment, the first subpixel to be colored by the retardation change is provided with a color filter of a color, such as magenta, that is complementary to green. As a result, it becomes possible considerably to enlarge the color reproduction range of red and blue.

Figure 3:
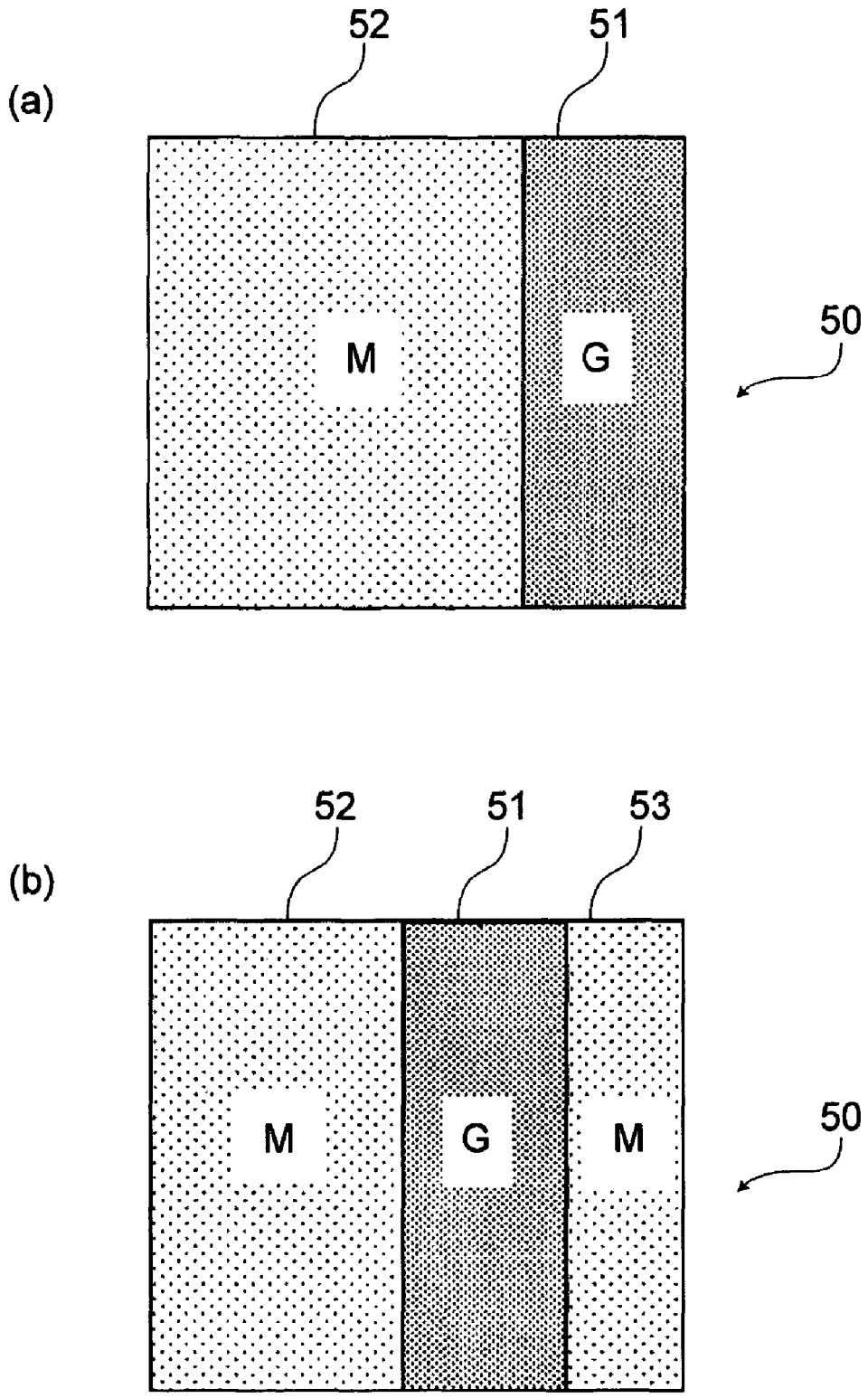
FIGS. 3(*a*) and 3(*b*) are views showing another structure of one pixel of the above-described liquid crystal display device.

FIGS. 3(*a*) and 3(*b*) show such a pixel construction. A green pixel 51 is provided with a green color filter similarly as in the above-described basic embodiment. Further, first subpixels 52 and 53, which are transparent, are provided with a magenta color filter indicated by M. Incidentally, FIG. 3(*a*) shows the case of one first subpixel, and FIG. 3(*b*) shows the case of two first subpixels divided into two portions at a ratio of 2:1.

At the green subpixel 51, similarly as in the above-described basic embodiment, modulation is performed in a brightness change modulation range to change the brightness of green, and at the first subpixels 52 and 53, modulation is performed in a hue change modulation range to display chromatic color and modulation is performed in the brightness change modulation range to effect display of changing the brightness of magenta.

Figure 4:
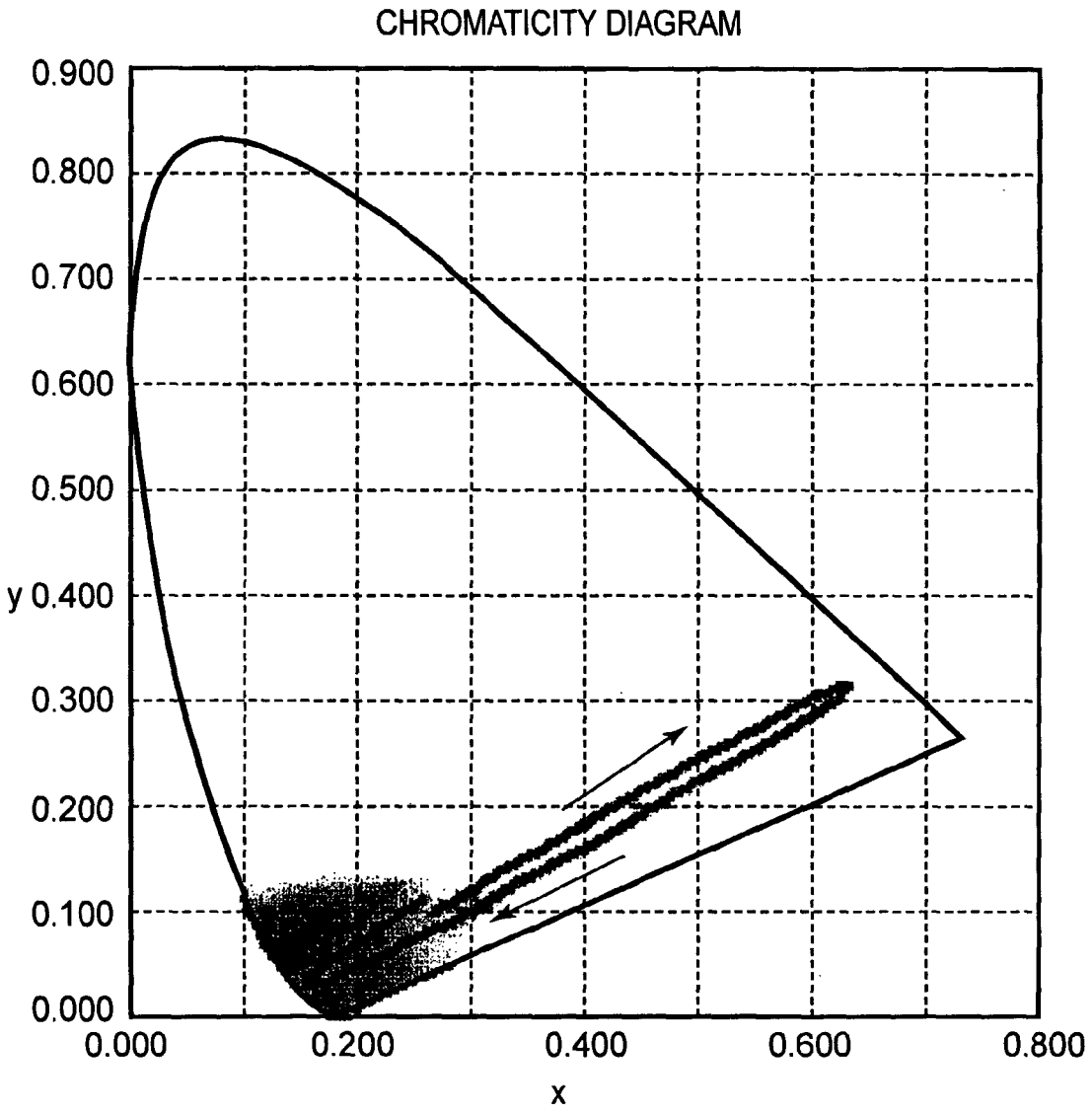
FIG. 4 is a diagram showing a hue change at the time of retardation change of the above-described liquid crystal display device.

Herein, calculated values with respect to a change in color by retardation in the case where an ideal magenta color filter which provides a transmittance of zero in a wavelength range of 480-580 nm and a transmittance of 100% in other ranges is provided is shown in FIG. 4. In FIG. 4, as the retardation amount is increased from zero, a brightness change of chromatic color such that the display state is changed from the black state to a bright magenta state via a dark magenta state (halftone magenta state) is achieved. Thereafter, when the retardation amount is further increased and exceeds the white range in the above-described embodiment in which the first subpixel 52 is not provided with the color filter, a continuous change in chromatic color in the order magenta, red, reddish violet (magenta), violet and blue is achieved.

When comparison between FIG. 4 and FIG. 2 is made, the range of change in chromaticity is extended near to pure colors of red and blue (located corners of chromaticity diagram), so that it is found that the color reproduction ranges of red and blue are extended by providing the magenta color filter. Further, the change from red to blue is moved along the lower side of the chromaticity diagram, so that it is also found that a continuous change in color mixture from red to blue is achieved. In this manner, it is possible to enlarge the color reproduction ranges of red and blue by providing the magenta color filter and achieve the continuous change in intermediary color when the retardation is changed.

Incidentally, in order to display white in this method, the same retardation value (250 nm) providing a maximum transmittance is set both at the subpixels provided with a color filter of magenta (hereinafter, referred to as magenta subpixels) 52 and 53 and the green subpixel 51. Alternatively, it is also possible to place the green subpixel 51 in the maximum transmittance state (retardation value: 250 nm) and the magenta subpixels 52 and 53 in an intermediary state between red and blue (retardation value is about 550 nm). Incidentally, in the former case, in order to change the brightness of achromatic color, the retardation of magenta subpixel is changed with the retardation of the green subpixel 51 so that gradation levels of both the subpixels 51, 52 and 53 are changed together.

The cases of displaying black, the single chromatic color of RGB, and the mixed color of these colors are the same as in the basic construction described above.

The gradation representation in the case where the magenta subpixel is divided into two portions is similar to that in the case of FIG. 1(*b*) in the basic construction.

As in this method, by using the color filter of color, such as magenta, which is complementary to green, it is possible to represent gradation of the color complementary to green together with gradation representation of the achromatic color, so that the number of displayable colors can be remarkably increased. Further, the magenta color filter permits transmission of both of red and blue, so that it is possible to effect a bright display as compared with the conventional method using the red color filter and the blue color filter in combination.

(3) Method Adding Pixel Provided with Color Filters for One or Both of Red and Blue.

Figure 5:
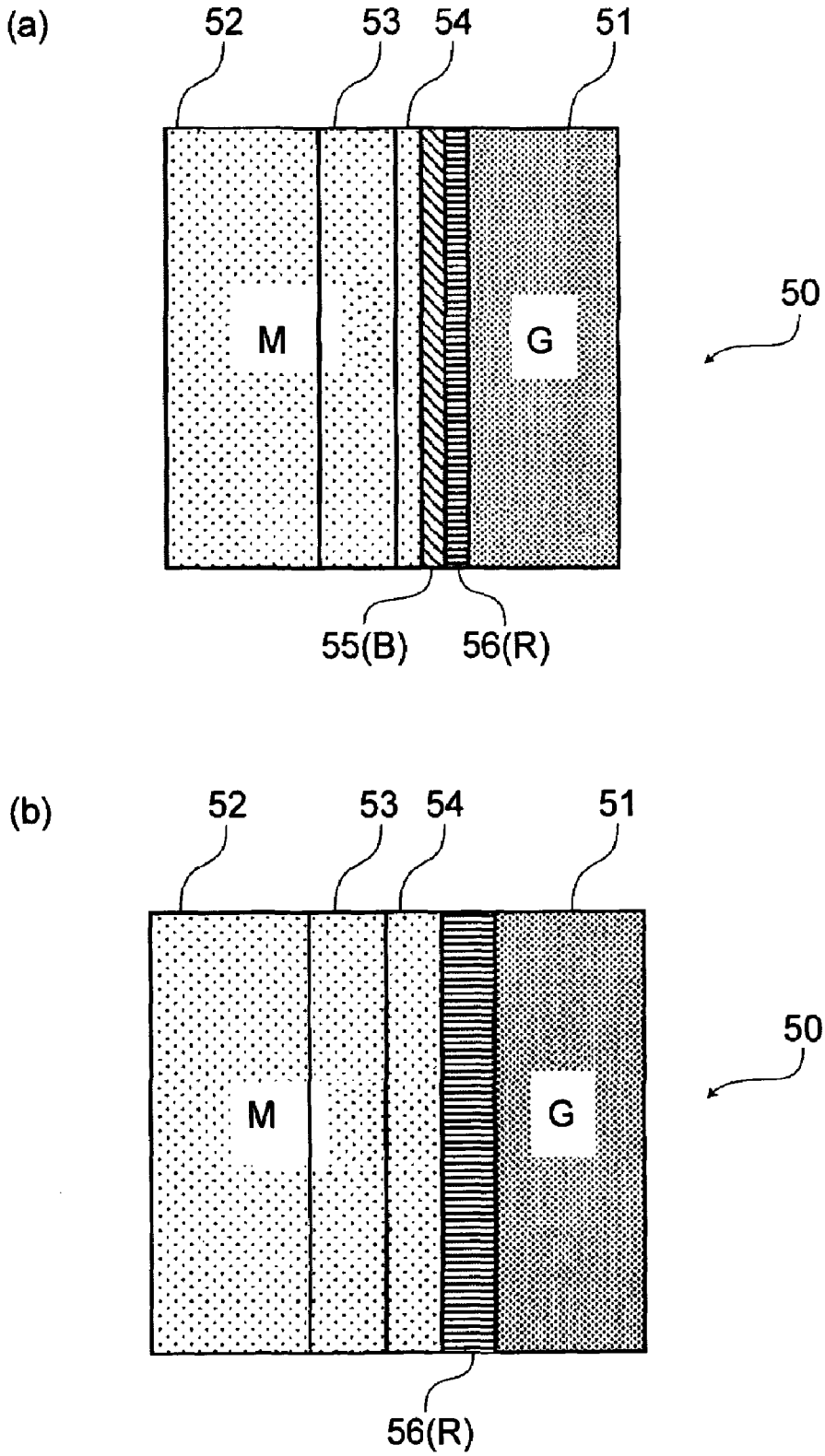
FIGS. 5(*a*) and 5(*b*) are views showing another structure of one pixel of the above-described liquid crystal display device.

FIG. 5(*a*) shows a pixel constitution according to this method, wherein a third subpixel 55 provided with a blue color filter indicated by B and a fourth subpixel 56 provided with a red color filter indicated by R are added to the G pixel 51 described in Method (2) and magenta subpixels 52, 53 and 54 which are divided into three portions at an areal ratio of 4:2:1.

The display actions at the green subpixel 51 and the magenta subpixels 52, 53 and 54 are the same as in the above described methods. At the green subpixel 51, the brightness of green is continuously gradation-displayed by performing the modulation in the low retardation range. At the magenta subpixels 52, 53 and 54, continuous modulation is performed in the same retardation range or the colors of red, blue and intermediary colors therebetween are displayed in the larger retardation range of chromatic color.

On the other hand, at the third and fourth subpixels 55 and 56, similarly as in the green subpixel 51 modulation is performed in the retardation range of 0-250 nm, whereby the brightnesses of blue and red are continuously changed. This function will be described with reference to the above-described FIG. 24.

Figure 24:
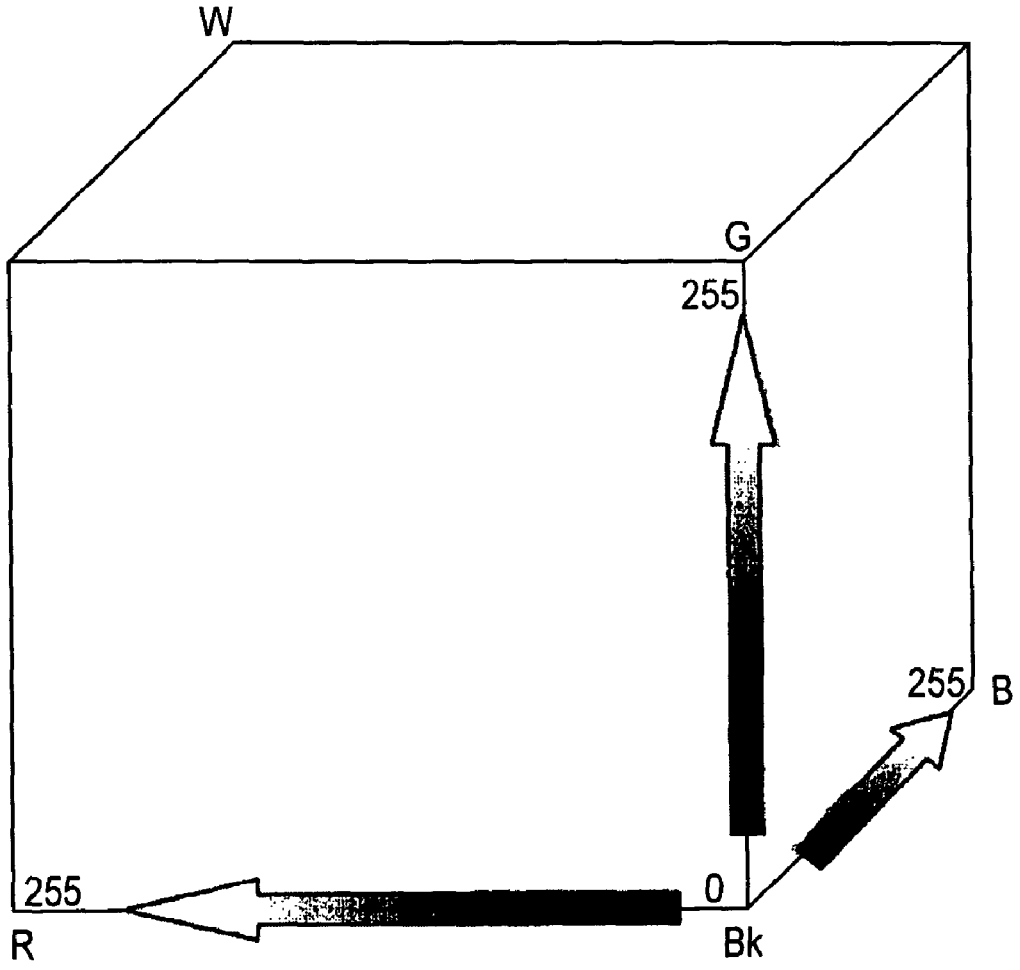
FIG. 24 is a view showing a color solid.

FIG. 24 shows displayable colors in RGB additive color mixture system, wherein an arbitrary point in a cube represents a color mixture state of red, green, or blue corresponding to an associated coordinate, and a vertex represented by "Bk" shows a state of a minimum brightness. When image information signals of red (R), green (G) and blue (B) are supplied, a display color corresponding to a position (point) of the sum of independent vectors of R, G and B each extended from the vertex "Bk". Incidentally, vertices "R", "G" and "B" in the figure represent maximum brightness states of red, green and blue, respectively, and a vertex "W" represents a white display state at a maximum brightness. Incidentally, a length of one side of the cube is 255.

Here, in the display device according to this method, with respect to green, it is characteristic that the continuous gradation display is effected by the color filter, so that the display color may be located at any point in a green direction. Therefore, in the following description, when the display color is discussed, it is discussed with regard to a plane constituted by red and blue vectors (hereinafter referred to as an "RB plane").

Figure 6:
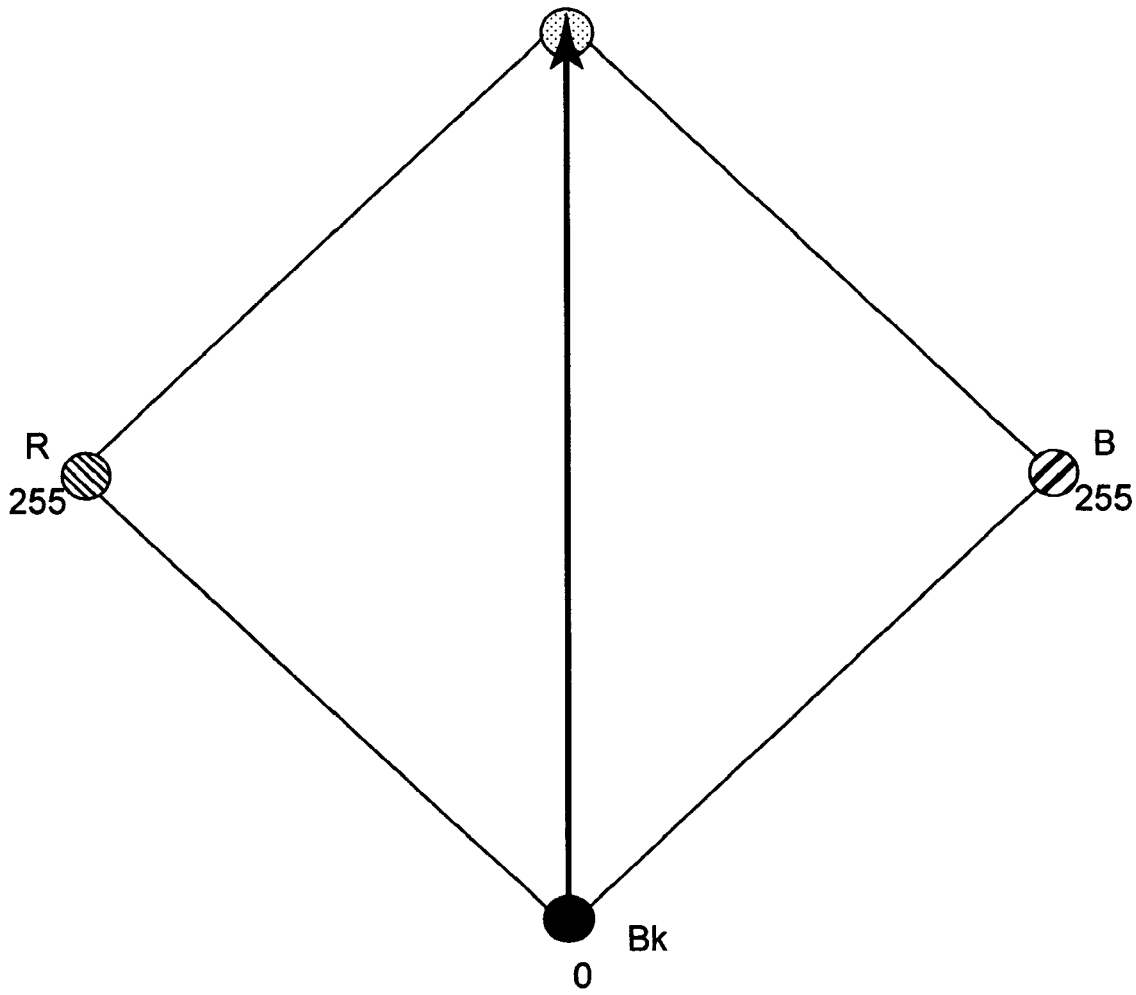
FIG. 6 is a view showing a display state on an RB plane of the above-described liquid crystal display device.

First of all, the case where a pixel utilizing the coloring phenomenon based on the ECB effect is used (the case of no pixel division) will be described with reference to FIG. 6 which shows an RB plane. During red display and blue display, the coloring phenomenon based on the ECB effect is utilized, so that available states as bright and dark states are two values of "ON" and "OFF". Accordingly, available points on the R-axis and the B-axis are two points representing a maximum value (R, B) and a minimum value (Bk).

On the other hand, in the case of the construction described in Method (2), i.e., the case where the color filter of magenta complementary to green is provided, it is possible to change the brightness of magenta by changing the retardation at the magenta subpixel in the range of 0-250 nm. Accordingly, the display color in this range corresponds to a continuous change in brightness being achieved on an axis in the direction of a synthetic vector of R and B indicated by arrows in FIG. 6. More specifically, in FIG. 6 in Method (2), any point selected from the point "Bk", the points "R" and "B", and those on the arrow can be utilized as the display color.

Figure 7:
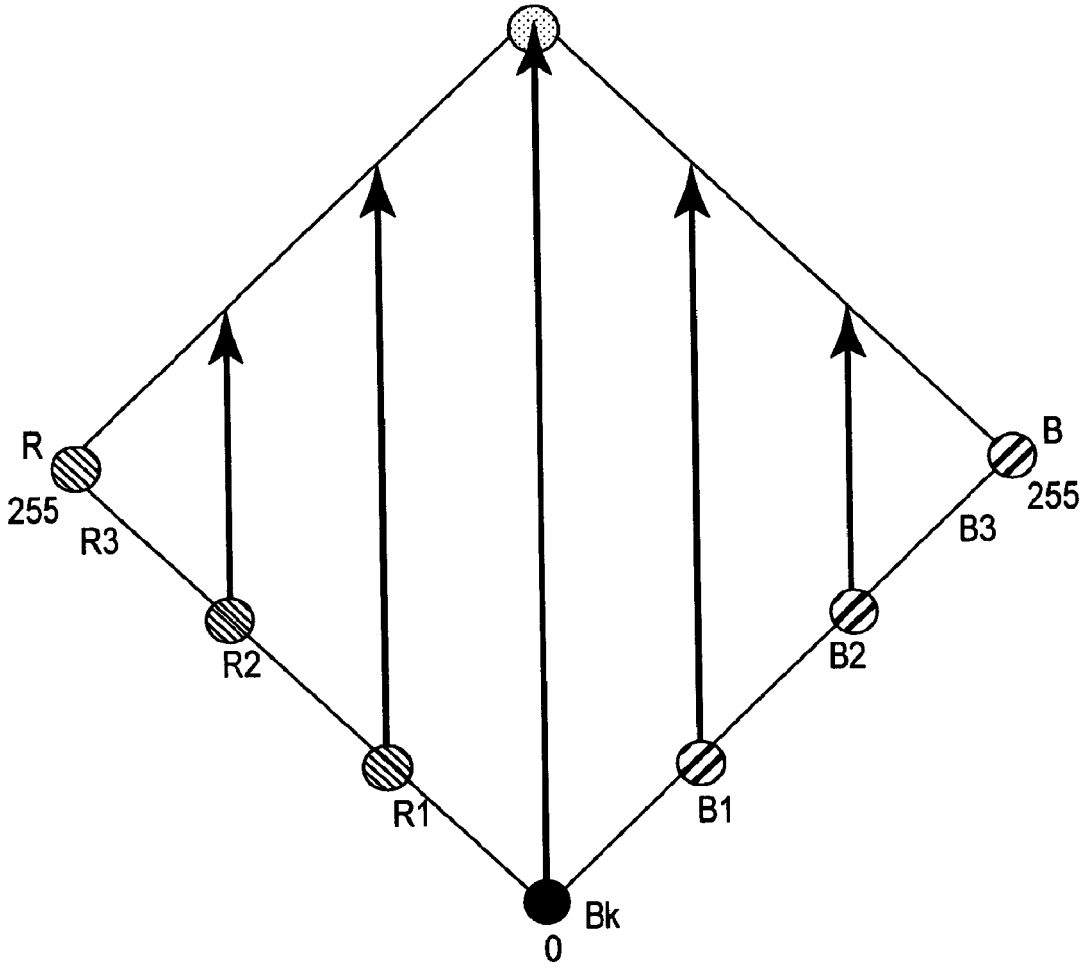
FIG. 7 is a view showing a display state on an RB plane of the above-described liquid crystal display device.

Next, the case where the pixel utilizing the coloring phenomenon based on the ECB effect is divided into two subpixels in an areal ratio of 1:2 will be described with reference to the RB plane shown in FIG. 7.

Also in this case, similarly to the case of no pixel division, the coloring phenomenon based on the ECB effect is utilized during the red display and the blue display, so that available dark and bright display states are two values of "ON" and "OFF" for each of the divided pixels. Further, one pixel is divided into two subpixels at the areal ratio of 1:2, so that four points indicated by circles are available on each of the axis-R and the axis-B.

Herein, at the points indicated by R3 and B3 in the figure, the corresponding two pixels are placed in the red display state and the blue display state, respectively. At each of the indicated points R1 and B1, the corresponding pixel which is a smaller pixel of the divided two pixels is placed in a blue display state or a red display state, and the remaining larger pixel is placed in a black display state. The large pixel can assume continuous gradation color for magenta, so that it can be located at any point on each of the arrows extending from the points R1 and B1 in the RB synthetic vector direction. By a similar discussion, it can also be located at any point on each of the arrows extending from the points R2 and B2 in the RB synthetic vector direction.

More specifically, the first subpixel 52 provided with the magenta color filter is divided into two subpixels having different areas. At one of the divided two subpixels, the chromatic color of red or blue is displayed, and at the other subpixel, a digital halftone magenta is displayed by effecting display for changing the brightness. At the green pixel, it is possible to continuously change the brightness, so that it is possible to effect color display by this method.

Figure 8:
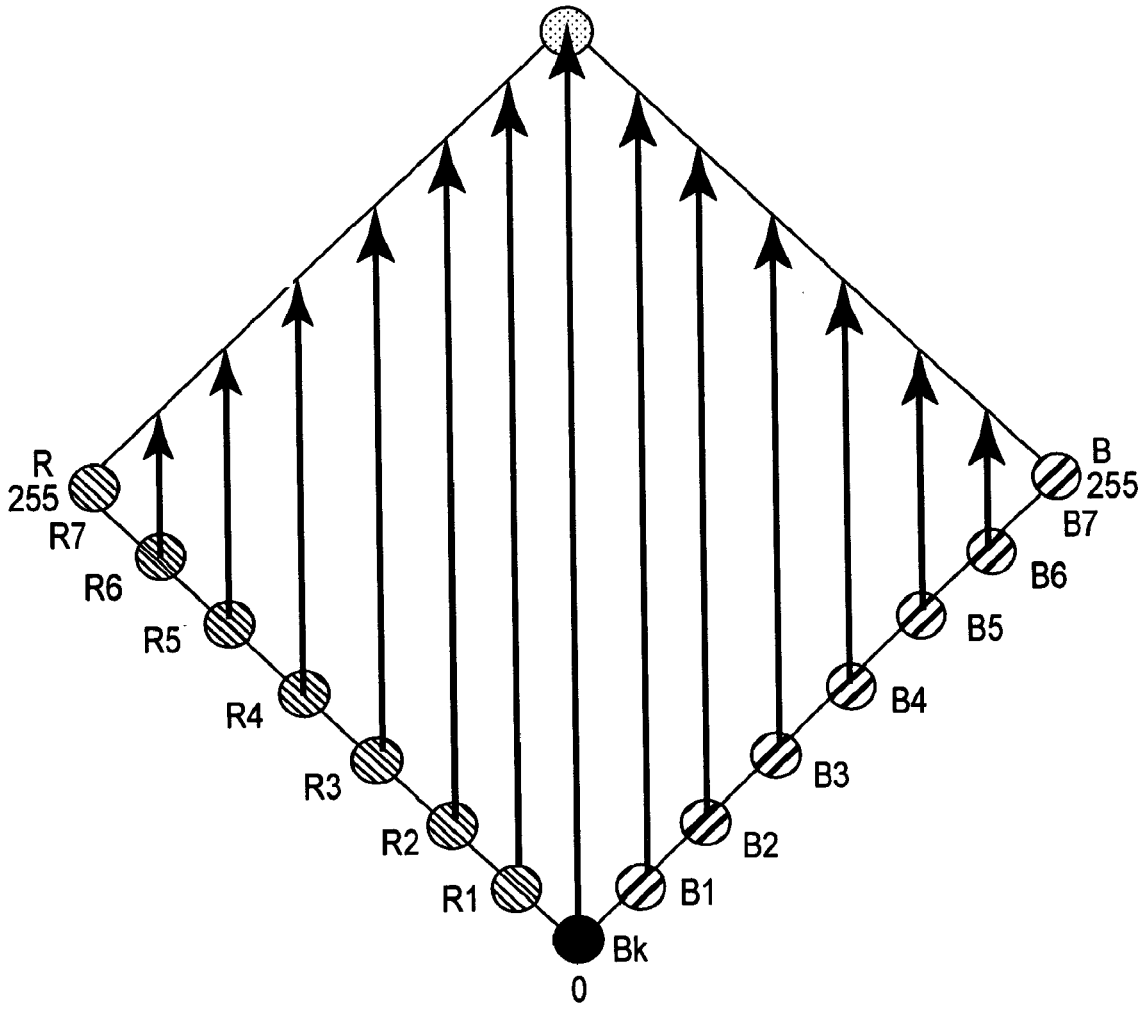
FIG. 8 is a view showing a display state on an RB plane of the above-described liquid crystal display device.

By a similar discussion, in the case where the pixel utilizing the coloring phenomenon based on ECB effect is divided into subpixels at an areal ratio of 1:2:4, available display colors are indicated by arrows in FIG. 8.

Generally, the first subpixel (utilizing the ECB effect-based coloring phenomenon) is provided with the magenta color filter and is divided into a plurality of subpixels having different areas. At a part of the subpixels, chromatic color of red or blue is displayed, and at a remaining part of the subpixels, a digital halftone magenta is displayed by effecting display for changing the brightness.

Further, as the number of pixel division is increased, the number of displayable colors on the RB plane is also increased. However, this method is just on the digital gradation, not the analog full-color display method.

Accordingly, in order to realize the analog gradation, third and fourth subpixels 55 and 56 provided with color filters of red and blue are added as shown in FIG. 5(*a*). Here, at these subpixels 55 and 56, a continuous change in brightness of blue or red is achieved, so that the displayable color is represented by a variable magnitude vector in the axis-B direction or the axis-R direction in FIGS. 7 and 8. By this means, it is possible to display continuous gradation levels of red and blue. Accordingly, it becomes possible to complement portions other than the arrows shown in FIGS. 7 and 8, so that it is possible to represent all the points on the RB plane.

More specifically, the second subpixel (subpixel for only the brightness modulation) is divided into a plurality of subpixels including one thereof (green subpixel 51) provided with a green color filter and a remaining part (third and fourth subpixels 55 and 56) provided with red and green color filters. At each of the divided subpixels of the second subpixel, a change in brightness is achieved by performing modulation in the brightness change range, whereby continuous gradation is added to the above described display of the digital halftone magenta to effect display of arbitrary halftone on the RB plane. By combining this with continuous gradation of green, it is possible to effect full-color display.

The third and fourth subpixels 55 and 56 of the second subpixels, provided with the red and blue color filters, are used to compensate the colors other than those of digital gradation of magenta displayed at the first subpixel, so that modulation may be performed so that the maximum brightness is substantially identical to a brightness at the minimum subpixel of the subpixels constituting the first subpixel described above.

In this case, a size of each of the added third and fourth subpixels 55 and 56 provided with the color filters of red and blue, respectively, is sufficient so long as it has an area comparable to that of a minimum-sized subpixel 54 of the above-described divided subpixels 52, 53 and 54. More specifically, e.g., in FIG. 8, the displayable points indicated by circles extending from the point "Bk" to the point "R7" and to the point "B7" are located at the same spacing. Further, it is possible to utilize any point on the arrows extending from the respective circle points in the RB composite vectors.

Figure 9:
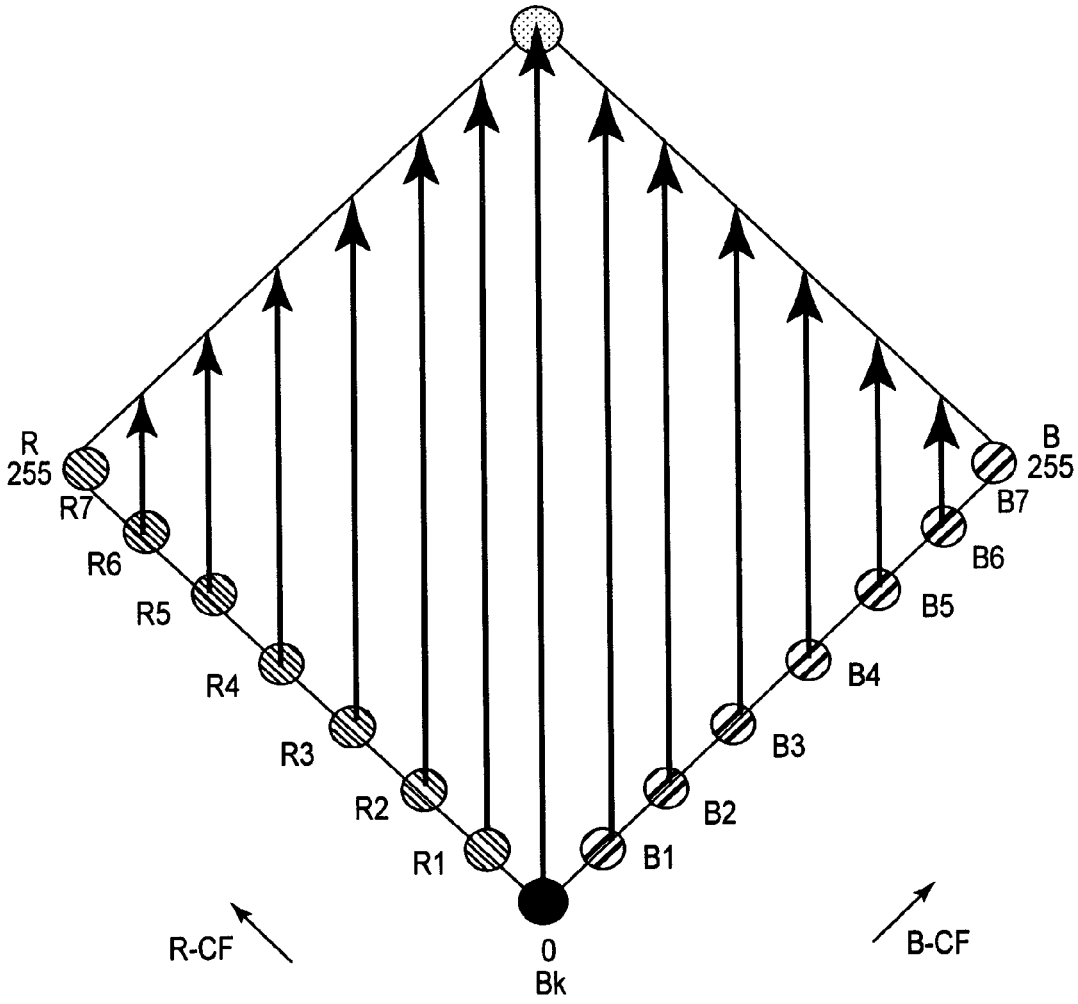
FIG. 9 is a view showing a display state on an RB plane of the above-described liquid crystal display device.

To such a color displayable constitution, the third and fourth subpixels 55 and 56, provided with the color filters of red and blue, each having the same area as the associated minimum-sized subpixel of the pixel-divided subpixels are added, whereby it is possible to effect the additive color mixture at any point in a direction of each of arrows R-CF and B-CF shown in FIG. 9. By this means, it is possible to represent all the points in the RB plane, so that it becomes possible to effect complete analog full-color display.

Further, as described above, the size of the added third and fourth subpixels 55 and 56 provided with the red color filter and the blue color filter is sufficient so long as it has the same area as the minimum-sized subpixel of the pixel-divided subpixels. For this reason, as the pixel division number is increased, it is possible effectively to alleviate the influence of a lowering in light utilization efficiency due to the use of the red and blue color filters. In other words, as the number of divisions of each pixel utilizing the coloring phenomenon based on the ECB effect is increased, it becomes possible to realize a higher light utilization efficiency.

Incidentally, in this case, it is possible to achieve an effective result even when the red color filter and the blue color filter are not necessarily both added. For example, FIG. 5(*b*) shows such an embodiment, in which only the subpixel 56 provided with the red color filter is added. Incidentally, a displayable color range is indicated by the hatched (dotted) area in FIG. 10 when only the red color filter is added. In the figure, in the red direction, all the colors are displayable, but in the blue direction, there are colors which are not displayable. However, with respect to human luminosity sensitivity characteristics, blue is the color to which our eyes are least sensitive, so that the number of necessary gradation levels is considered to be smallest. Accordingly, it is possible to obtain the display colors substantially comparable to full-color levels by adding only the red color filter.

Figure 10:
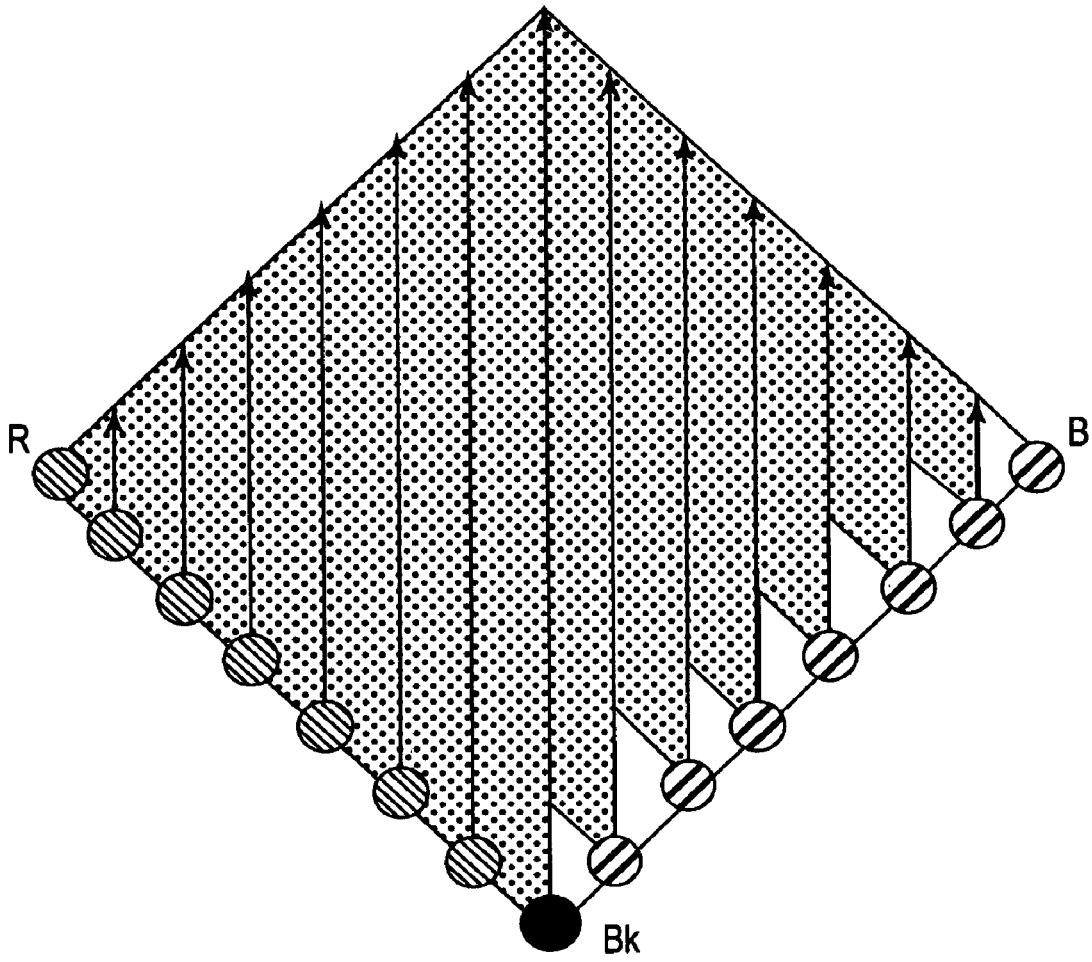
FIG. 10 is a view showing a display state on an RB plane of the above-described liquid crystal display device.

In a construction which is completely the same as that shown in FIG. 10, the referential point "Bk" is shifted to the position of the point "R1" in FIG. 9, whereby it is possible to represent all the display colors. Incidentally, in this case, the black display state provides a slightly reddish display color but such a method is also applicable to uses in which the contrast obtainable with the resultant display device e.g., as in the reflection-type display device need not be too great as compared with the transmission-type display device.

By the above described methods, it becomes possible to display the display colors identical or comparable to the full color levels while retaining high light utilization efficiency.

Incidentally, this construction is applicable to various liquid crystal display modes described below in addition to such a vertical alignment (VA) mode that the liquid crystal molecules in the liquid crystal layer are substantially homeotropically aligned with respect to the substrate surface under no voltage application and are inclined from the substantially homeotropic alignment state so as to change the retardation under application of voltage.

The present invention is applicable to an optically compensated bend (OCB) mode, in which the retardation is changed by changing the alignment state of liquid crystal molecules between a bend alignment state and the substantially homeotropic alignment state under application of voltage, similarly to the case of the VA mode.

Further, in this construction, the display colors based on the change in retardation are utilized, so that a change in hue depending on the viewing angle has to be taken into consideration. However, the progress of LCD development in these days is remarkable, so that it is not too much to say that the problem of viewing angle dependency is substantially solved in color liquid crystal displays using the RCB color filter method. For example, in the OCB mode, it has been reported that the change in retardation due to the change in viewing angle is suppressed by a self-compensation effect by bend alignment. Further, due to the progress in the development of a phase-difference film in an STN mode, the viewing angle characteristic is remarkably improved.

Also, in these OCB and STN modes, it is possible to realize the coloring phenomenon based on the ECB effect by appropriately setting the amount of retardation, so that the construction of the present invention is applicable thereto. Particularly, in the OCB mode, it is possible considerably to increase the above-described response speed, so that the OCB mode is suitable for use where high-speed responsiveness is required.

On the other hand, an MVA (multidomain vertical alignment) mode has already been commercialized as a mode providing a very good viewing angle characteristic and has been widely used. In addition, a PVA (patterned vertical alignment) mode has also been used widely.

In these vertical alignment modes, the wide viewing angle characteristic is realized by providing a surface unevenness (MVA mode) or appropriately shaping an electrode (PVA mode) to control an inclination direction of liquid crystal molecules under voltage application. In these modes, the amount of retardation is changed by the voltage, so that the constitution of the present invention is applicable to the modes. By doing so, it becomes possible to realize the color liquid crystal display device satisfying the higher transmittance (or reflectance), the wide viewing angle, and the broad color space at the same time.

Incidentally, in the above description, green having a high luminosity factor is independently treated and other colors are displayed at the pixels other than the green pixel by utilizing the coloring effect by birefringence. By doing this, it is most advantageous for displayablity of natural picture, as described above. However, it is not necessarily only green that is treated independently, but rather it is also possible to utilize a method wherein the red pixel is treated as an independent pixel and blue and green are displayed by utilizing the coloring effect by birefringence, or a method wherein the blue pixel is treated as the independent pixel and red and green are displayed by utilizing the coloring effect by birefringence.

Further, although the above-described construction is repeated, the present invention is applicable to various display devices without limiting the liquid crystal device so long as the medium which changes an optical property by an externally applied modulation signal is used and exhibits the brightness changing modulation area and the hue changing modulation area by the modulation means. As an example thereof, it is possible to employ a display mode wherein a thickness of an interference layer is mechanically changed by an external modulation means and an electrophoretic display device capable of controlling different colors in a unit pixel by using migration particles of a plurality of colors.

The principle of the display device used in the present invention has been described in detail above. Here, a point to be mentioned specially is that display information is given on the basis of the same principle as in the conventional display device with respect to one color (e.g., green) but on the other hand, display is effected on the basis of a principle utterly different from that of the conventional display device with respect to the remaining two colors (e.g., red and blue).

More specifically, in the conventional display system, the remaining two colors (e.g., red and blue) are controlled by respective independent signals. However, in the display system in the present invention, at least the remaining two colors (e.g., red and blue) and their intermediary colors are required to be information-outputted to the display device capable of displaying the colors at the same subpixel. Accordingly, the display system is also required to be different from the conventional display system.

Figure 11:
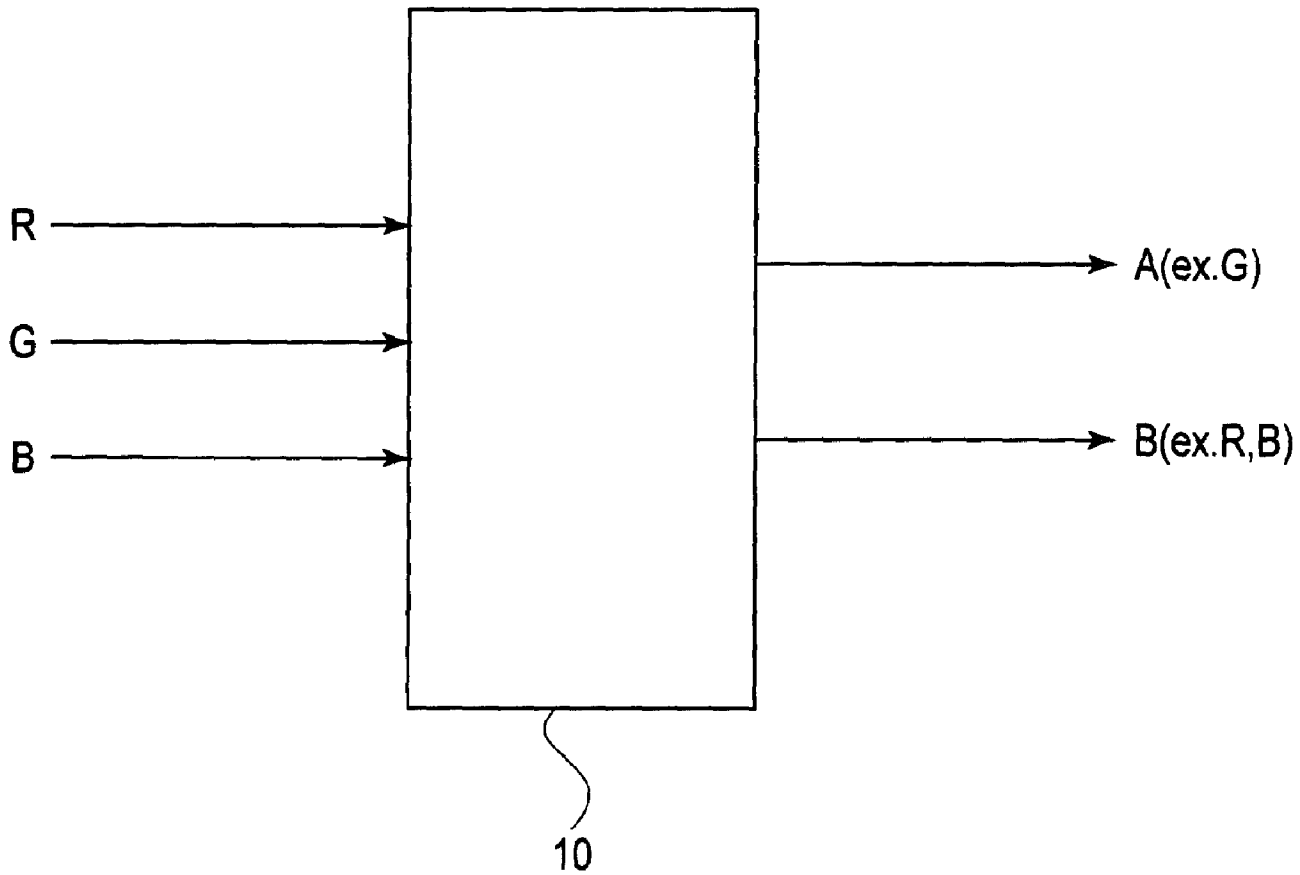
FIG. 11 is a view showing a concept of a color display used in the above-described color display apparatus.

FIG. 11 is a basic concept view of a system block according to such an embodiment of the present invention.

In the figure, 10 is an input/output means. First, as an image signal, information signals of three types of RGS enter the input/output means 10 similarly as in the already-existing display system. In this display system, an output signal for displaying one color (A) of these three colors and output information for displaying other two colors (B) are obtained.

This display system is connected to the display portion, i.e., a matrix display panel comprising a plurality of pixels disposed in a matrix fashion as typically shown in FIG. 1. The display system includes a memory for storing an image signal and a circuit for picking up the image signal in some cases. These circuits constitute a control portion of the display panel. The display portion and the control portion constitute the display apparatus of the present invention.

An output signal of the display system 10 is sent to each pixel through a drive circuit (not shown) in the display portion. A is sent to the subpixel (51 in FIG. 1) provided with the color filter and is a signal for determining a brightness of the subpixel. B is sent to the other subpixel (52 in FIG. 1) and is a signal for determining a hue at the subpixel. At this subpixel, a chromatic color different from the color of the color filter at the subpixel to which the signal of A is sent is displayed. The chromatic color may be two colors of the inputted three colors but it is also possible to display an intermediary hue between the two colors by adjusting birefringence.

Here, with respect to A (with certain exceptions), it may be considered that A is subjected to a processing independently from other colors and then an output signal is transmitted to the display device substantially similarly as in the already-exiting display system. On the other hand, with respect to B, it is subjected to a new processing different from the conventional one and an output signal for controlling these two colors is transmitted to the display device.

These first display signal and second display signal are outputted to the display device which effects color display, so that it becomes possible to effect natural picture display without using the conventional three independent color output signals.

Next, the display system in the present invention will be described more specifically with reference to FIGS. 1-6. Incidentally, in these embodiments, green is used as A described hereinabove and red and blue are used as the other two colors (B), for purposes of explanation. Incidentally, in the case where red is intended to be used as A, blue and green may be used as B, and in the case where blue is intended to be used as A, red and green may be used as B.

Further, a common constitution of the liquid crystal display device as an example of the color display device used in the embodiments of the present invention is as follows.

As a structure of a liquid crystal layer, two glass substrates subjected to vertical alignment treatment are applied to each other to prepare a cell. As a liquid crystal material, a liquid crystal material (Model: "MLC-6608", Manufactured by Merck & Co., Inc.) having a dielectronic anisotropy ($\Delta\epsilon$) which is negative is used. Incidentally, at this time, the cell thickness is set as necessary to provide an optimum retardation, depending on the embodiment being used.

Further, with regard to the substrate structure used, one of the substrates is an active matrix substrate provided with thin film transistors (TFTs) and the other substrate is a substrate provided with color filters. In this case, a shape of pixels and a color filter constitution are changed appropriately depending on the embodiment used.

As a pixel electrode on the TFT side, an aluminum electrode is used to provide a reflection-type construction.

Between an upper substrate (color filter substrate) and a polarization plate, a wide-band $\lambda/4$ plate (phase-compensation plate capable of substantially satisfying ¼ wavelength condition in visible light region) is disposed as a photo-compensation plate, thereby to provide such a construction that a dark state is given under no voltage application and a bright state is given under voltage application when reflection-type display is effected.

Embodiment 1

Figure 12:
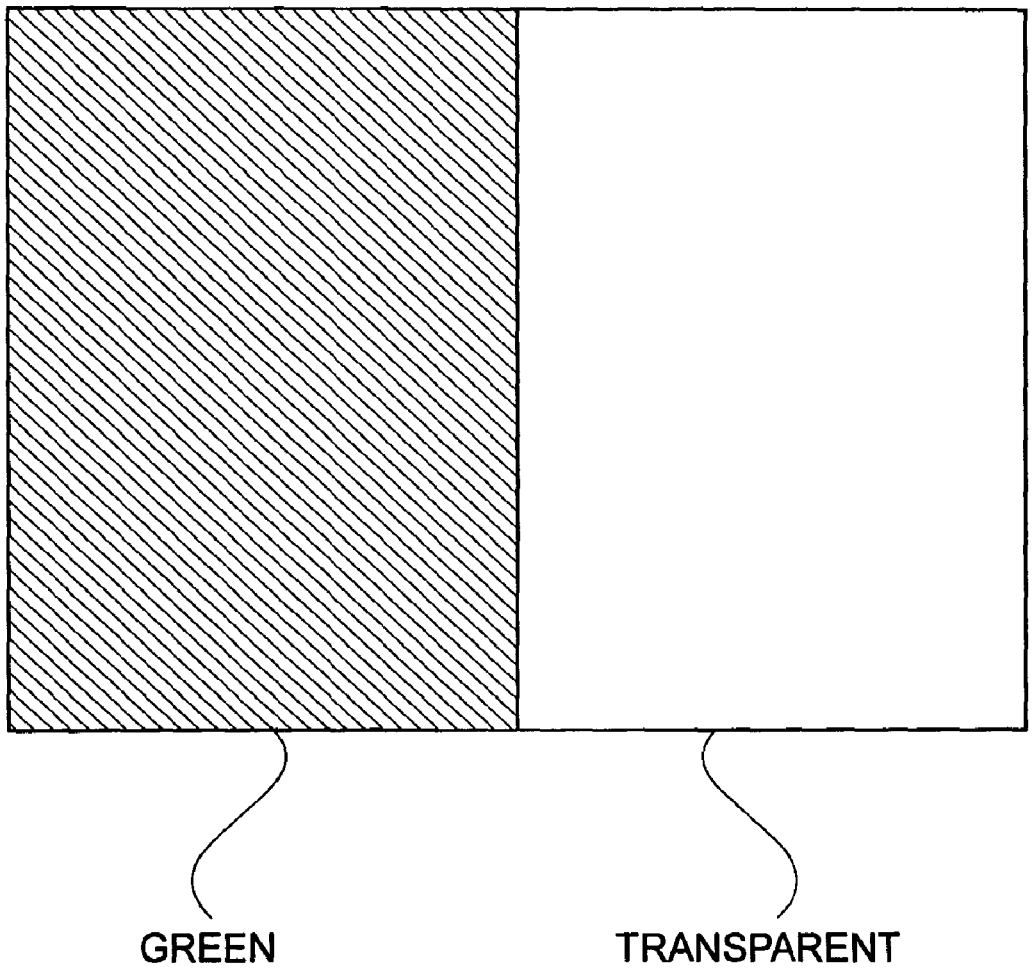
FIG. 12 is a view showing one pixel structure in Embodiment 1 according to the above-described best mode.

A pixel construction of a liquid crystal display device used in Embodiment 1 is given, as shown in FIG. 12, by dividing one unit pixel into two subpixels and providing a green color filter to only one of the subpixels. The remaining one subpixel is not provided with a color filter. Incidentally, the cell thickness of this device is 5 microns.

At this time, an amount of retardation at the time of applying a voltage of ±5 V to a transparent subpixel provided with no color filter is about 300 nm.

When such a liquid crystal display device is subjected to image display by changing the voltage, with respect to the subpixels with the green color filter, a change in transmittance depending on the applied voltage value is shown in an area of not more than 3 V to provide a continuous gradation characteristic. On the other hand, with respect to other transparent subpixels, blue display is effected under application of 5 V and red display is effected under application of 3.8 V, so that it is found that the liquid crystal panel in this embodiment effects display with respect to the three primary colors. Further, in the area of not more than 3 V, monochromatic continuous gradation display depending on the applied voltage is effected.

Figure 13:
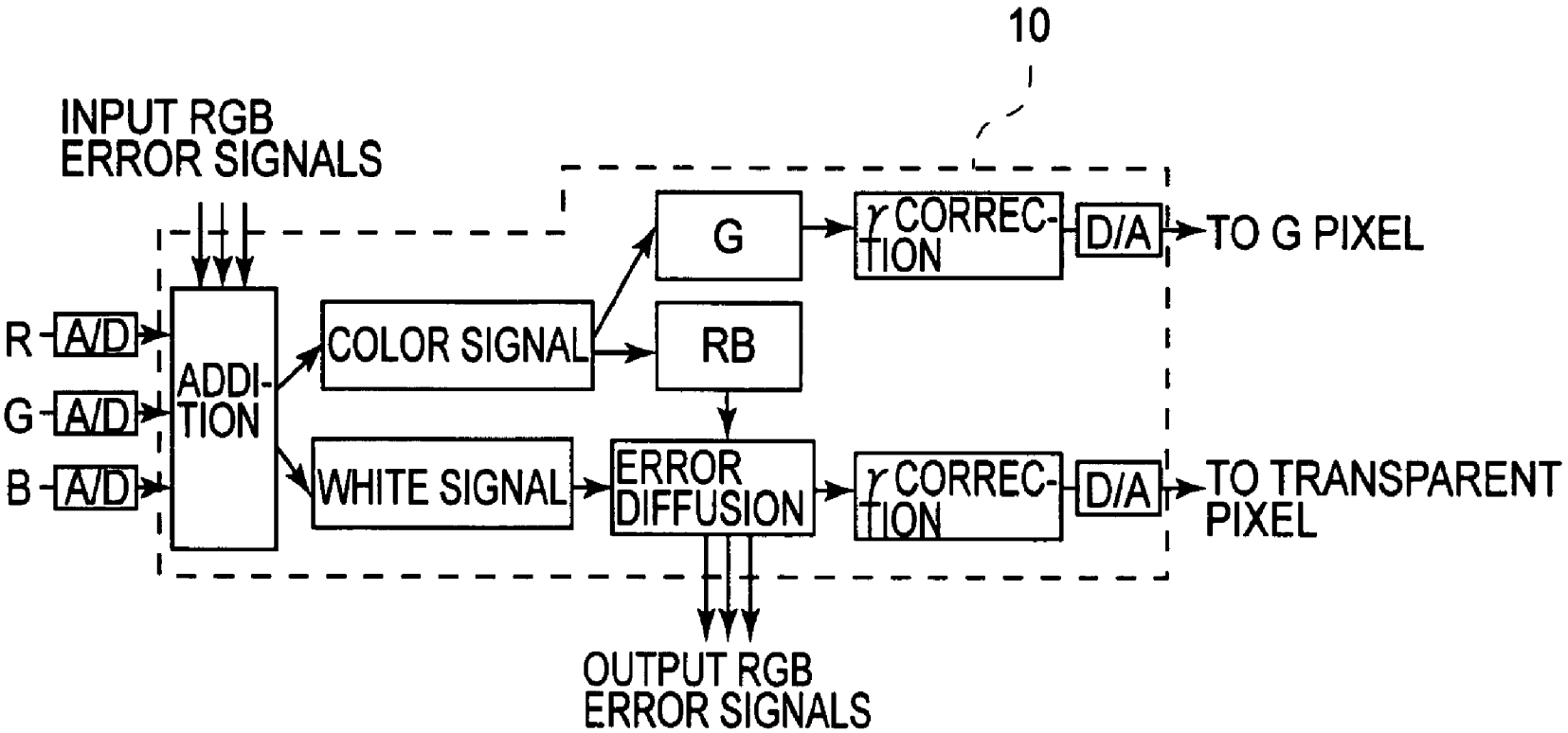
FIG. 13 is a block diagram of a color display system in the above-described Embodiment 1.

In this case, an example of a display system when RGB signals are inputted as input image signals is shown in FIG. 13. In the figure, an example of a system in which error diffusion processing is performed is shown as the example of the display system. Further, in this system, 256 gradation levels from 0 to 255 are processed as gradation information to be processed.

Here, in this display system, input analog RGB signals are A/D-converted first for signal processing in the input/output means 10. At this time, gamma correction may also be performed, as desired (not shown). Incidentally, in the case where the input signals are digital RGB signals, the A/D conversion processing is not particularly required. Next, the error diffusion processing is performed in this system, so that RGB error signals are added from adjacent signals. With respect to data after the addition, signal processing is performed.

Incidentally, during the signal processing in this embodiment, the data are first separated into a color signal component and a white (monochromatic) signal component. More specifically, the minimum of the three sum components (Ri+Re, Gi+Ge, Bi+Be) of input RGB signals (Ri, Gi, Bi) and input error signals (Re, Ge, Be), i.e., [(min (Ri+Re, Gi+Ge, Bi+Be)], is calculated, so that a monochromatic component can be extracted. The color signal components after the extraction of the monochromatic component are (Ri+Re−min (Ri+Re, Gi+Ge, Bi+Be), Gi+Ge−min (Ri+Re, Gi+Ge, Bi+Be), Bi+Be−min (Ri+Re, Gi+Ge, Bi+Be)). Of these, with respect to a green component (Gi+Ge−min (Ri+Re, Gi+Ge, Bi+Be)), this amount of green is outputted to a green subpixel. Incidentally, when this output is made, gamma correction is performed depending on the characteristic of the liquid crystal display device, and thereafter a color signal component of green which is one of separated colors is A/D-converted to be supplied as a source signal corresponding to the green subpixel of the liquid crystal display device.

Further, a red component (Ri+Re−min (Ri+Re, Gi+Ge, Bi+Be)) and a blue component (Bi+Be−min (Ri+Re, Gi+Ge, Bi+Be)) which are two separated colors are appropriately subjected to error diffusion processing together with the previously separated monochromatic component. Various algorithms may be considered with respect to this error diffusion processing, but in this embodiment, the processing is effected in the following manner.

First, the maximum of the monochromatic component (min (Ri+Re, Gi+Ge, Bi+Be), the red component (Ri+Re−min (Ri+Re, Gi+Ge, Bi+Be)), and the blue component (Bi+Be−min (Ri+Re, Gi+Ge, Bi+Be)) is calculated. Here, for example, in the case where a display color having the maximum is the monochromatic component, with respect to an output to the transparent subpixel, the monochromatic signal component may be outputted as it is. Further, the red component and the blue component are assigned to adjacent pixels.

Further, in the case where the display color having the maximum is the red signal component, an output to the transparent subpixel is the red signal component (Ri+Re−min (Ri+Re, Gi+Ge, Bi+Be)). However, an intermediary tone of red cannot be displayed in the liquid crystal display device of the present invention, so that as the number of gradation levels of red outputted actually to the transparent subpixel is 255 (maximum). Accordingly, a difference between it and an amount of gradation to be naturally outputted (255−(Ri+Re−min (Ri+Re, Gi+Ge, Bi+Be))) is an error component. A total of this error component of red, the monochromatic signal component, and the blue component may be assigned to adjacent pixels are an error.

Further, when these respective signal components are outputted to the transparent pixels, the gamma correction is performed depending on a characteristic of the liquid crystal display device and thereafter, these respective signal components are D/A-converted and supplied as source signals corresponding to the transparent pixels of the liquid crystal display device.

As described above, with respect to the input RGB signals, by using the display system capable of supplying the output signals to the green subpixel and the output signals to the transparent subpixels, it becomes possible to display a natural image in the display device capable of effecting the three primary color display in this embodiment.

Embodiment 2

Figure 14:
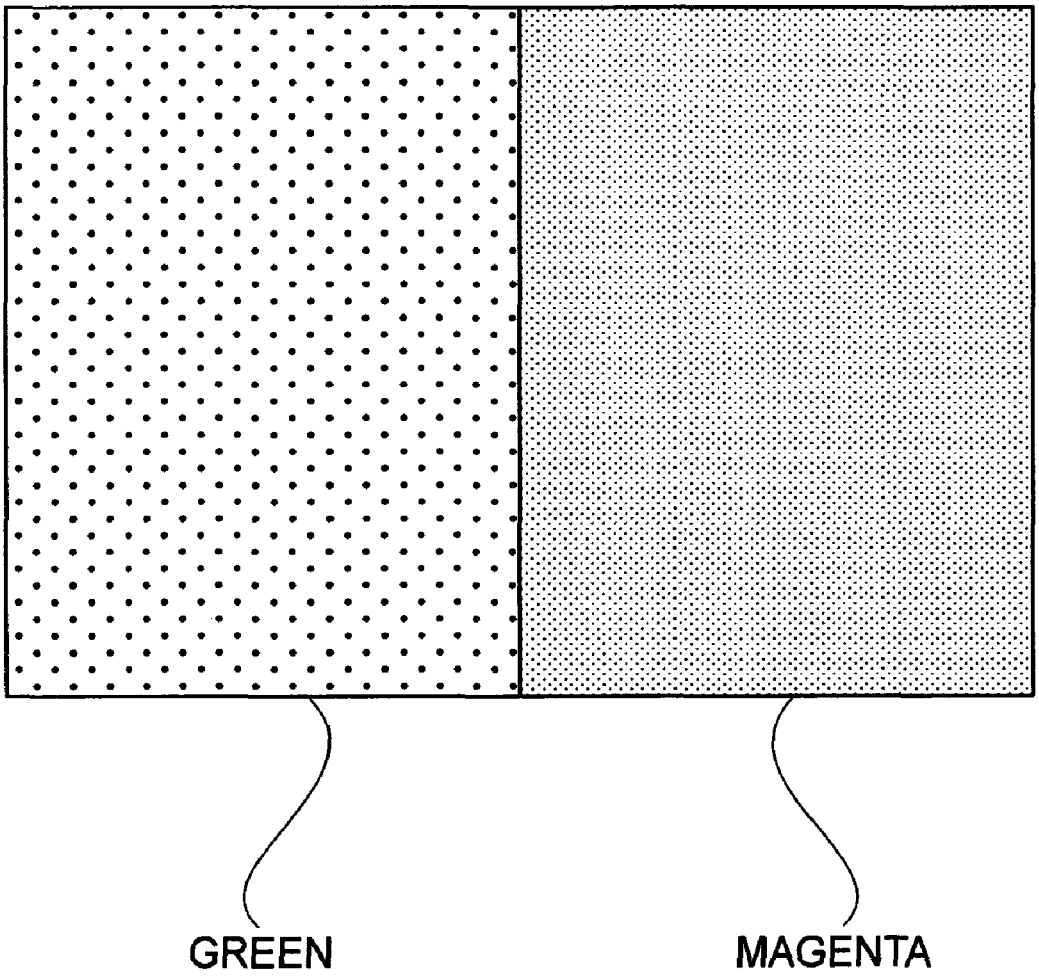
FIG. 14 is a view showing the structure of one pixel in Embodiment 2 according to the above-described best mode.

A pixel construction of a liquid crystal display device used in embodiment 2 is given, as shown in FIG. 14, by dividing one unit pixel into two subpixels and providing a green color filter to one of the subpixels and a magnetic color filter to the remaining one subpixel. Incidentally, the cell thickness of this device 5 microns.

At this time, an amount of retardation at the time of applying a voltage of ±5 V to a magenta subpixel provided with no color filter is about 300 nm.

When such a liquid crystal display device is subjected to image display by changing the voltage, with respect to the subpixels with the green color filter, a change in transmittance depending on the applied voltage value is shown in an area of not more than 3 V to provide a continuous gradation characteristic. On the other hand, with respect to other subpixels provided with the magenta color filter, blue display is effected under application of 5 V and red display is effected under application of 3.8 V, so that it is found that the liquid crystal panel in this embodiment effects display with respect to the three primary colors. Further, in the area of not more than 3 V, magenta continuous gradation display depending on the applied voltage is effected.

Figure 15:
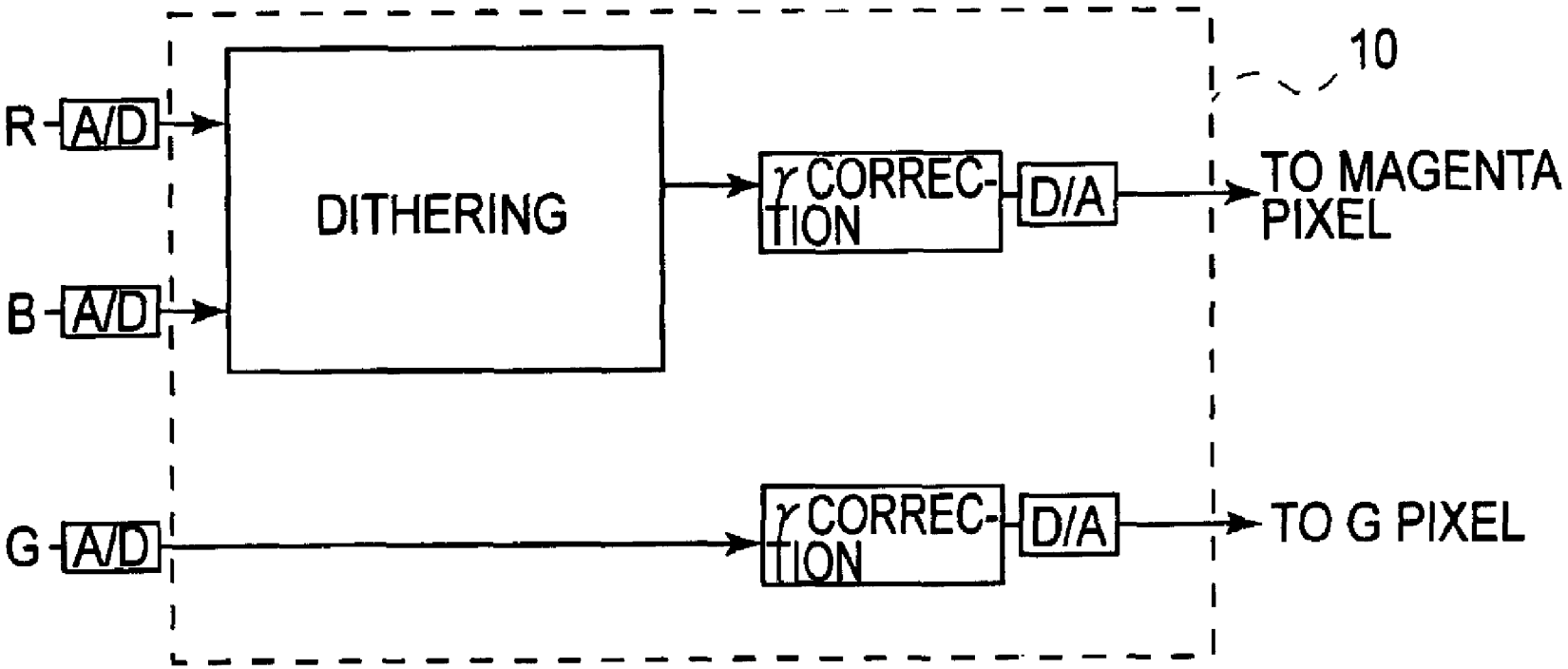
FIG. 15 is a block diagram of a color display system in the above-described Embodiment 2.

In this case, an example of a display system when RGB signals are inputted as input image signals is shown in FIG. 15. In that figure, an example of a system in which dithering is performed is shown as the example of the display system. Further, in this system, 256 gradation levels from 0 to 255 are processed as gradation information to be processed.

In this display system, input analog RGB signals are A/D-converted first for signal processing in the input/output means 10. At this time, gamma correction may also be performed, as desired (not shown). Incidentally, in the case where the input signals are digital RGB signals, the A/D conversion processing is not particularly required.

Next, this system is separated into two systems, viz., system 1, for processing green, and system 2, for processing red and blue. In system 2, dithering is effected with respect to these red and blue components.

Here, explanation will be made with respect to this dithering. In the case of this embodiment, green is separated in system 2, so that it is not necessary to consider the G-axis when the above described RGB color solid shown in FIG. 24 is taken into consideration, and thus a discussion may be made only about the RB plane. Further, in the liquid crystal display device described in this embodiment, as described above, the ECB effect-based coloring phenomenon is utilized at the time of displaying red and blue, so that available values as bright and dark states are two values of ON and OFF. Accordingly, available points on each of the R- and B-axes are two points consisting of a maximum (R, B) and a minimum (Bk).

On the other hand, the magenta color filter of the color complementary to green is provided, so that it is possible to change a blue of magenta. More specifically, in the RB plane shown in FIG. 6, it is possible to use the points Bk (origin point), R, B and many points on the arrow as the display color.

Incidentally, a plurality of discrete values used for image processing when an arbitrary input image signal is given are derived in the following manner.

Figure 25:
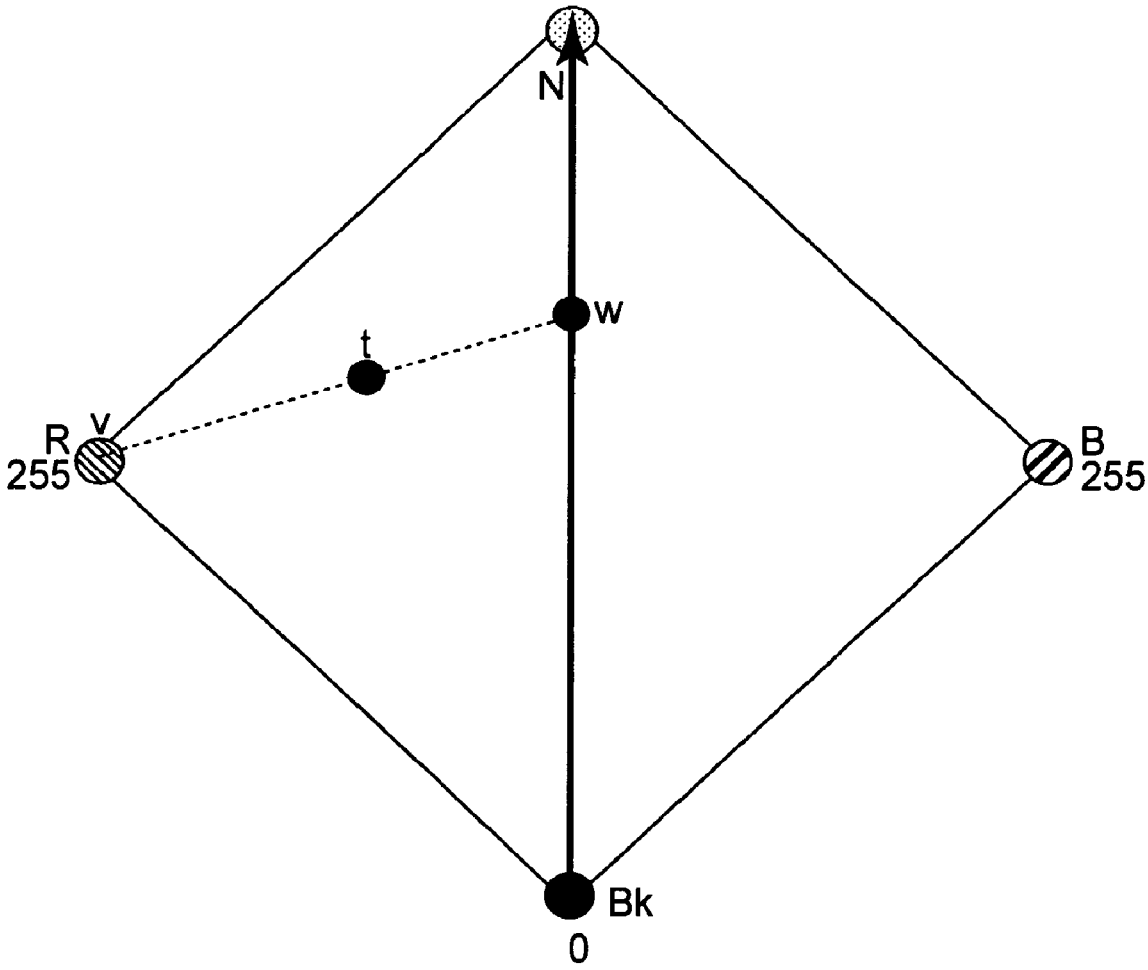
FIG. 25 is a view showing a display state on an RB plane in the above-described Embodiment 2.

As shown in FIG. 25, a point when an RB component of input image information is plotted on the RB plane, it is possible to achieve continuous brightness charge in the magenta direction. More specifically, when magenta continuous gradation is represented by an arrow N and a point representing a display color of R or B (a vertex of the RB plane) is taken as v, a point which intersects with the locus N on an extended line of a straight line connecting the point v and the point t is taken as w. Dithering is effected by using these selected points v and w. Incidentally, in this case, the point w is on the extended straight line of the straight line vt but may also be determined as an extrapolated value on the assumption of a predetermined curved line in view of the gamma characteristic or the like.

With respect to the RB components of the inputted analog signal, first a magnitude is compared between R and B. If R is large, the above described point v is red ((R, B)=(255, 0)) and if B is large, the above described point v is blue ((R, B)=(0, 255)).

Next, an absolute value (IR−BI) of a difference between the RB signals is calculated and the dithering in performed by using this value. The display panel is divided into a group of unit pixels consisting of numerical rows and columns of a dither matrix, so that an output signal is determined by comparing a magnitude relationship between an input image signal supplied to each pixel of the unit pixel group and the dither matrix. Here, for example, explanation is made with respect to a 4×4 dither matrix by using a Bayer-type dither matrix:

$$\begin{pmatrix} 8 & 136 & 40 & 168 \\ 200 & 72 & 232 & 104 \\ 56 & 184 & 24 & 152 \\ 248 & 120 & 216 & 88 \end{pmatrix}$$

A threshold matrix when a 4×4 Bayer-type dither is used in the case where there is information from 0 to 255 as the input signal is represented by the above described numerical formula 1. When the x and y coordinates on the display device are taken as (4N+a, 4N+b) (where N and M are integers, and a and b are integers of 0-3), the display device of this embodiment can be said to be an N×M display device comprising a pixel group of 4×4 pixels. Thus, depending on coordinates of (a, b), e.g., in the case of an input image signal with respect to a pixel at (a, b)=(0, 0), the value |R−B| of the input image signal and 8 as the value of coordinates (0, 0) of the above-described dither matrix are compared, so that display of the point v is effected if the input image signal is large and display of the point w is effected if the input image signal is small.

With respect to other coordinates, a similar processing is performed, so that it becomes possible to effect display of 17 gradation levels as the values of |R−B|. Incidentally, it is needless to say that the number of displayable gradation levels is increased by increasing the size of the above described-dither matrix to 8×8.

Further, in the above-described example, the amount (number) of gradation levels of |R−B| is 17 gradation levels, but an available value of the point w is a continuous amount, so that the number of display colors which are displayable in the RB plane is very large. Actually, from the viewpoint of constraints of the driver IC and the like, the number is limited to 64 gradation levels or 256 gradation levels, so that the number of display colors available on the RB plane is approximately several hundred to several thousand colors.

By the processing described above, a display color outputted to the magenta subpixel is determined. Further, the gamma correction is finally performed depending on the characteristic of the liquid crystal display device. Thereafter, the determined display color is D/A-converted and supplied as a source signal corresponding to the magenta subpixel of the liquid crystal display device.

Incidentally, a display color outputted to the green subpixel is D/A-converted after the input image signal is subjected to the gamma correction, so that it is supplied as a source signal corresponding to the green subpixel of the liquid crystal display device. Incidentally, with respect to, e.g., a case where the display color can only be outputted as a signal having a smaller number of bits than are in the input image signal from the viewpoint of constraints of driver IC, etc., as an image signal to be outputted to the green subpixel, it is possible to effect the output so as to provide a natural image by the number of gradation levels of green through the dithering according to the known method.

Further, it is preferable that an amount of gradation capable of being outputted to the green subpixel agrees with that of gradation capable of being outputted to the magenta subpixel in order to represent monochromatic continuous gradation. However, in the case of the liquid crystal display device in this embodiment, magenta has a wider dynamic range for display, so that when green and magenta have the same output but number, it is difficult to match the gradation numbers in the continuous gradation areas. Accordingly, it is effective to change the bit number every source line by using a low-temperature polysilicon TFT substrate.

Alternatively, a source electrode is formed in a comb-tooth shape to provide different driver ICs supplied for each one source line at upper and lower portions. For example, when setting is made so that information output to the green pixel is performed from the upper-side source driver and information output to the magenta pixel is performed from the lower-side source driver, it becomes possible to make a difference in the number of output bits between green and magenta, e.g., merely by changing the bit number of the upper-side driver IC and that of the lower-side driver IC when the driver ICs are mounted by using an amorphous TFT substrate.

Here, in a case where either one thereof is large, e.g., in a case where the gradation amount of green is larger than that of magenta, it is preferable that the gradation number of green is made an integral multiple of the gradation number of magenta to match the display gradation levels of green and magenta in order to effect monochromatic continuous gradation representation. In a case where the numbers of display gradation levels of green and magenta cannot be made to agree with each other, it is preferable that the monochromatic display area is adjusted to provide an achromatic color by an appropriate image processing.

As described above, with respect to the input RGB signals, by using the display system capable of supplying the output signals to the green pixel and the output signals to the magenta pixels, it becomes possible to display a natural image in the display device capable of effecting the three primary color display in this embodiment.

Embodiment 3

Figure 16:
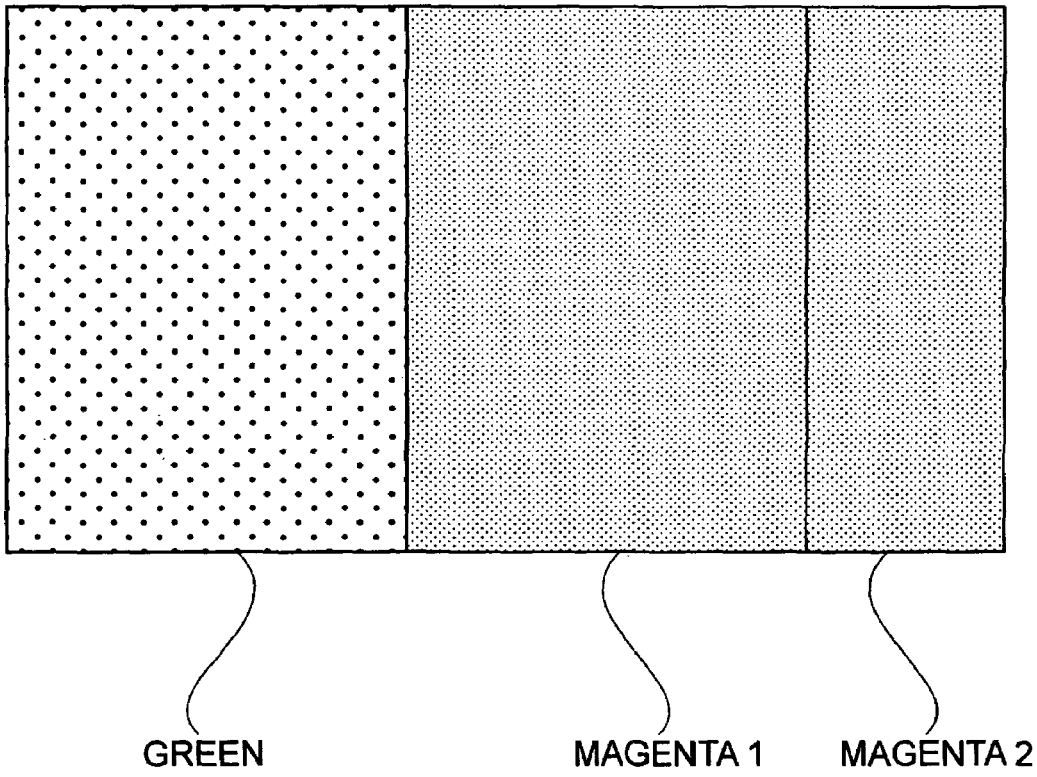
FIG. 16 is a view showing one pixel structure in Embodiment 3 according to the above-described best mode.

A pixel construction of a liquid crystal display device used in embodiment 3 is given, as shown in FIG. 16, by dividing one unit pixel into three subpixels and providing a green color filter to one of the subpixels and a magnetic color filter to the remaining two subpixels. Here, these two subpixels provided with the magenta color filter are set to have an areal ratio of 1:2. Incidentally, a characteristic of this liquid crystal display device is the same as that in embodiment 2. Further, in the range of not more than 3 V, it is possible to effect display of continuous gradation of magenta and effect 4 gradation representation also with respect to red and blue.

Figure 17:
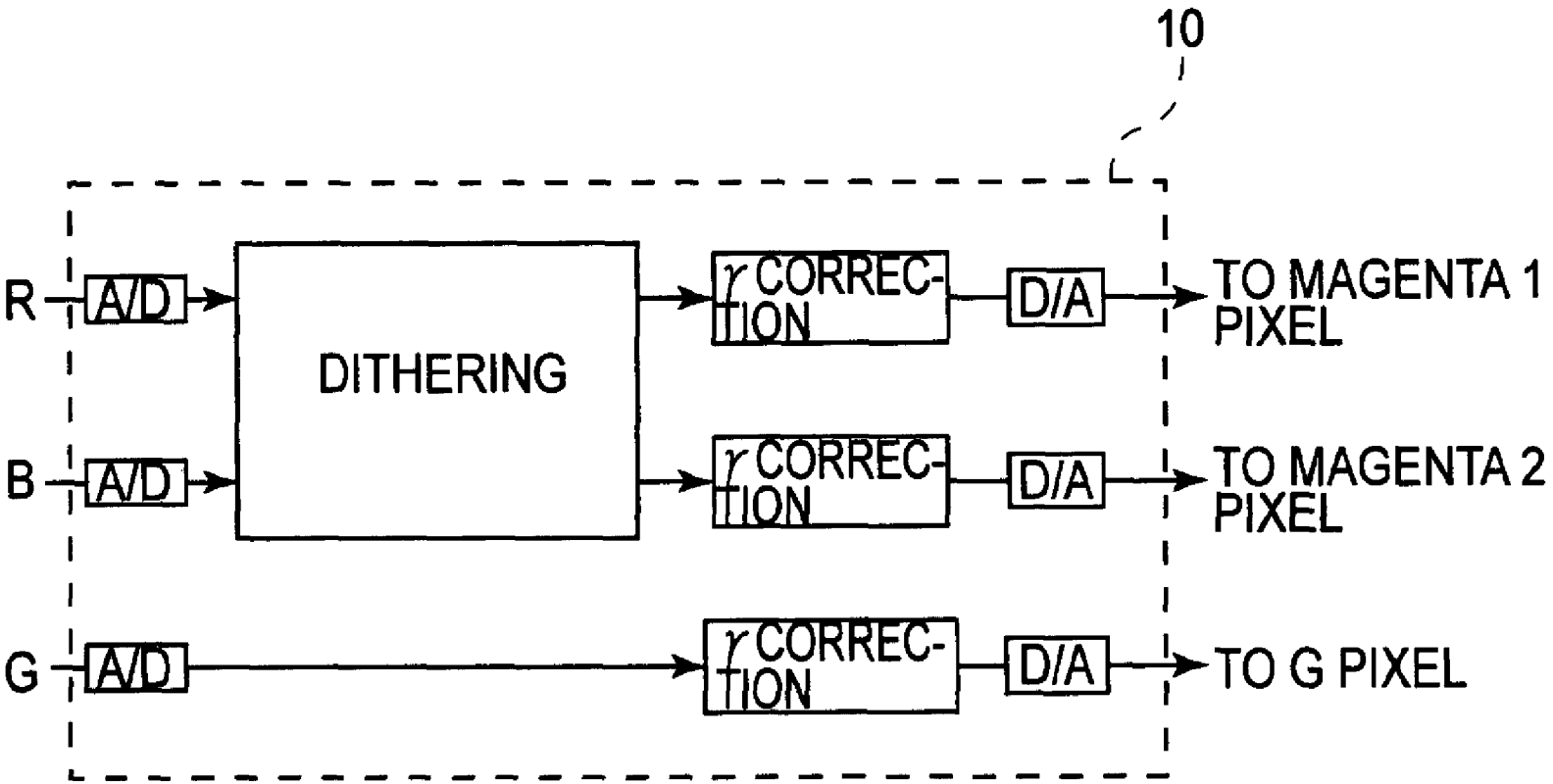
FIG. 17 is a block diagram of a color display system in the above-described Embodiment 3.

In this case, an example of a display system when RGB signals are inputted as input image signals is shown in FIG. 17. In this figure, an example of a system in which dithering is performed is shown as the example of the display system. Incidentally, in this embodiment, this dithering is performed so as to determine RB output information by modifying embodiment 2 through application of a known multivalued dithering-based concept.

Further, by such a multivalued dithering in the input/output means 10, a display color outputted to the two magenta subpixels is determined. Further, this display color is, after the gamma correction is finally performed depending on the characteristic of the liquid crystal display device, D/A-converted and supplied as a source signal corresponding to the magenta subpixel of the liquid crystal display device.

Incidentally, a display color outputted to the green subpixel is D/A-converted after the input image signal is subjected to the gamma correction, and is supplied as a source signal corresponding to the green subpixel of the liquid crystal display device. Incidentally, with respect to, e.g., the case where the display color can only be outputted as a signal having fewer bits than are in the input image signal from the viewpoint of constraints of driver IC, etc., as an image signal to be outputted to the green subpixel, it is possible to effect the output so as to provide a natural image by the number of gradation levels of green through the dithering according to the known method.

As described above, with respect to the input RGB signals, by using the display system capable of supplying the output signals to the green subpixel and the output signals to the magenta subpixels, it becomes possible to display a natural image in the display device capable of effecting the three primary color display in this embodiment.

Embodiment 4

Figure 18:
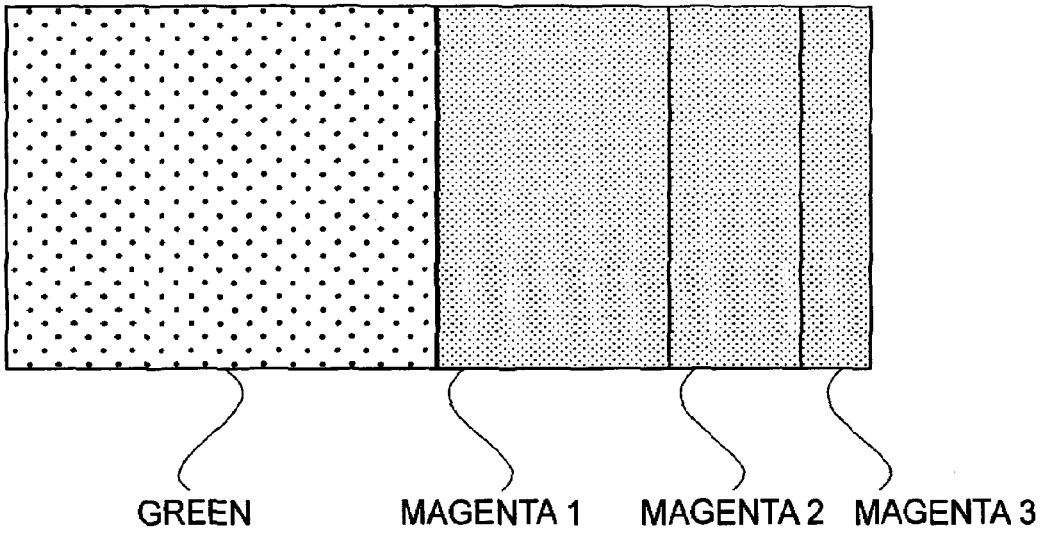
FIG. 18 is a view showing one pixel structure in Embodiment 4 according to the above-described best mode.

A pixel constitution of a liquid crystal display device used in embodiment 4 is given, as shown in FIG. 18, by dividing one unit pixel into four subpixels and providing a green color filter to one of the subpixels and a magnetic color filter to the remaining three subpixels. Here, these three subpixels provided with the magenta color filter are set to have an areal ratio of 1:2:4. Incidentally, the characteristic of this liquid crystal display device is the same as that in embodiments 2 and 3. Further, in the range of not more than 3 V, it is possible to effect display of continuous gradation of magenta and effect 8 gradation representation also with respect to red and blue.

Figure 19:
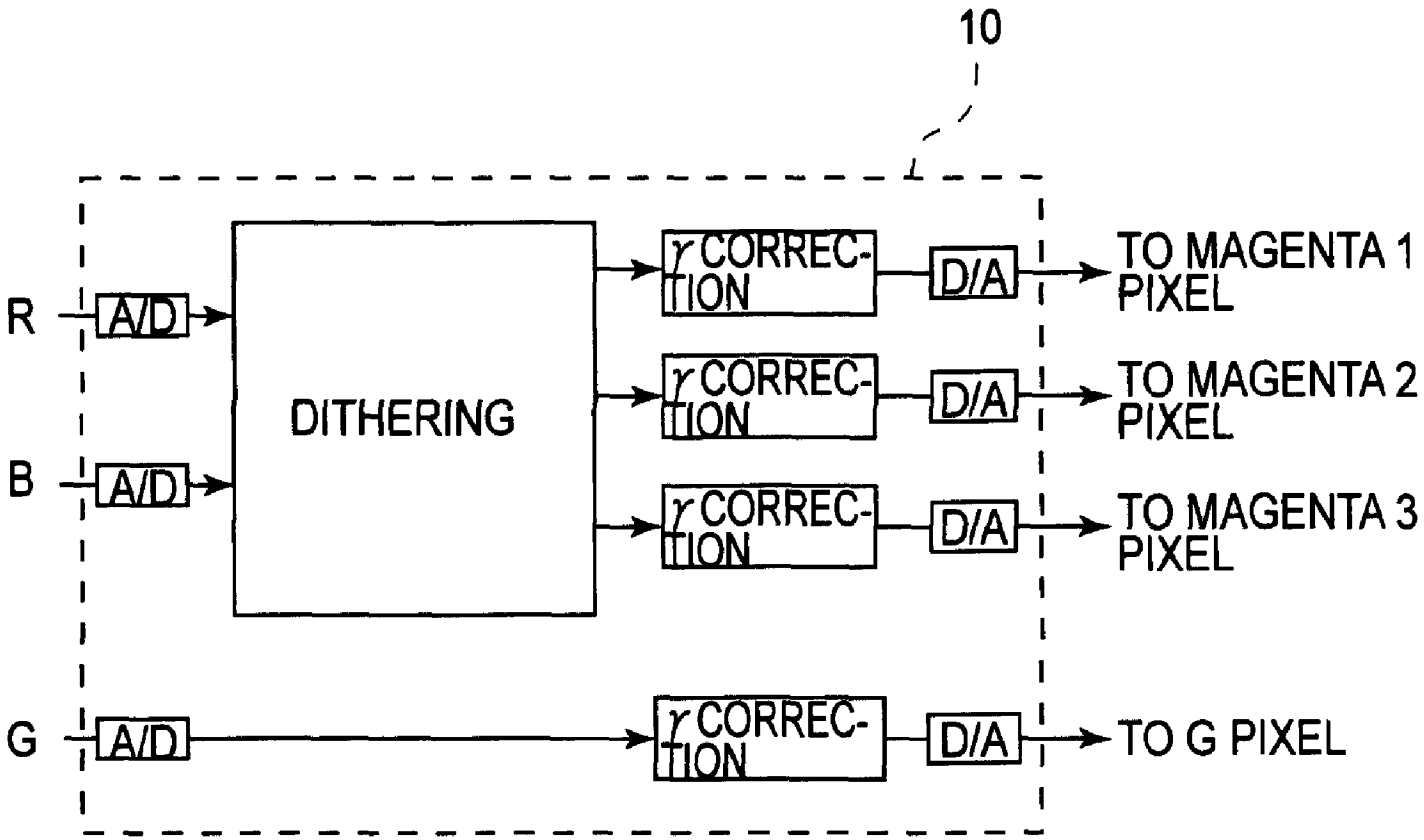
FIG. 19 is a block diagram of a color display system in the above-described Embodiment 4.

In this case, an example of a display system when RGB signals are inputted as input image signals is shown in FIG. 19. In the figure, an example of a system in which dithering is performed is shown as the example of the display system. Incidentally, with respect to details of dithering, it is possible to determine RB output information by modifying the same processing as in embodiment 3.

Further, by such a multivalued dithering in the input/output means 10, a display color outputted to the three magenta subpixels is determined. Further, this display color is, after the gamma correction is finally performed depending on the characteristic of the liquid crystal display device, D/A-converted and supplied as a source signal corresponding to the magenta subpixel of the liquid crystal display device.

Incidentally, a display color outputted to the green subpixel is D/A-converted after the input image signal is subjected to the gamma correction, and is supplied as a source signal corresponding to the green subpixel of the liquid crystal display device. Incidentally, with respect to, e.g., the case where the display color can only be outputted as a signal having fewer bits than are in the input image signal from the viewpoint of constraints of driver IC, etc., as an image signal to be outputted to the green subpixel, it is possible to effect the output so as to provide a natural image by the number of gradation levels of green through the dithering according to the known method.

As described above, with respect to the input RGB signals, by using the display system capable of supplying the output signals to the green subpixel and the output signals to the magenta subpixels, it becomes possible to display a natural image in the display device capable of effecting the three primary color display in this embodiment.

Embodiment 5

Figure 20:
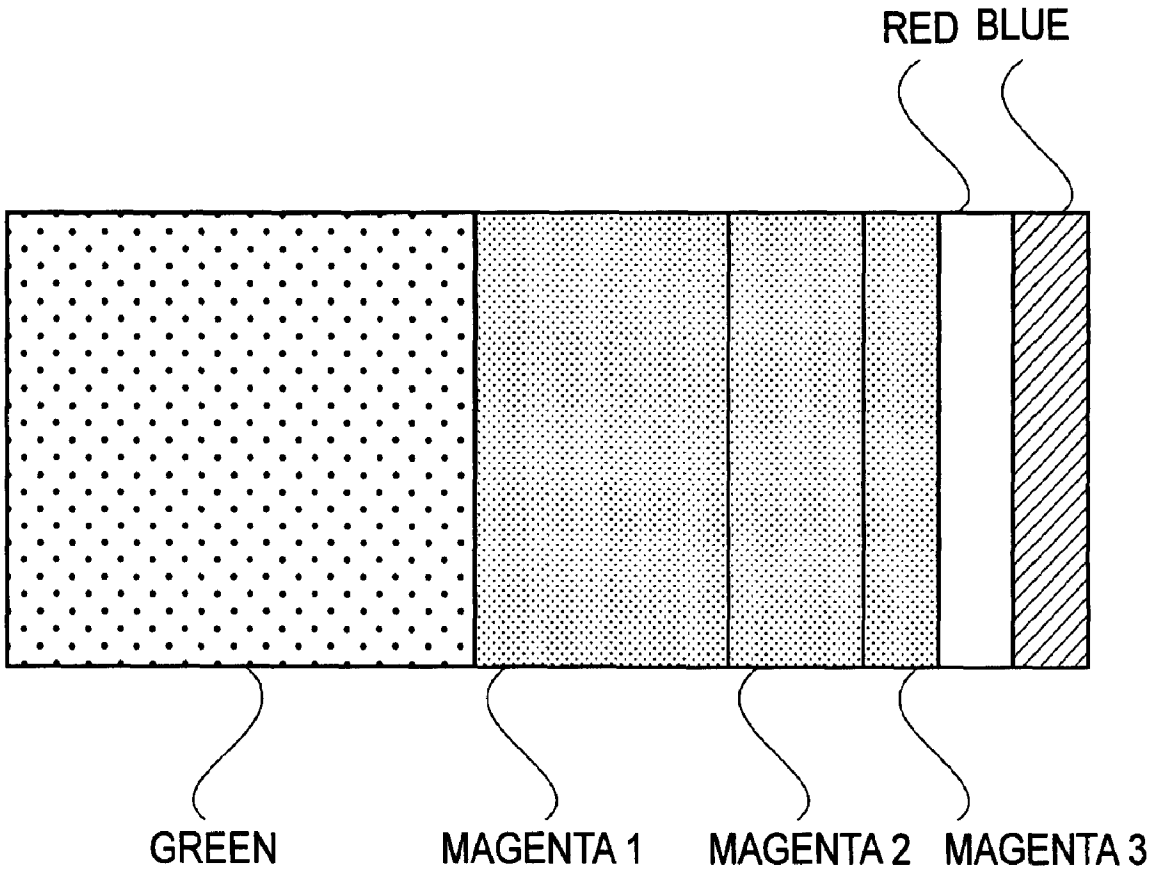
FIG. 20 is a view showing one pixel structure in Embodiment 5 according to the above-described best mode.

A pixel constitution of a liquid crystal display device used in embodiment 5 is given, as shown in FIG. 20, by dividing one unit pixel into six subpixels and providing a green color filter to one of the subpixels and a magnetic color filter to three of the remaining five subpixels. Here, these three subpixels provided with the magenta color filter are set to have an areal ratio of 1:2:4. Further, an area of the remaining two subpixels is identical to a minimum area of the subpixels provided with the magenta color filter and the two subpixels are provided with a red color filter and a blue color filter, respectively. Incidentally, a characteristic of this liquid crystal display device is the same as that in embodiments 2 and 3. Further, in the range of not more than 3 V, it is possible to effect display of continuous gradation of magenta and effect 8 gradation representation also with respect to red and blue.

Figure 21:
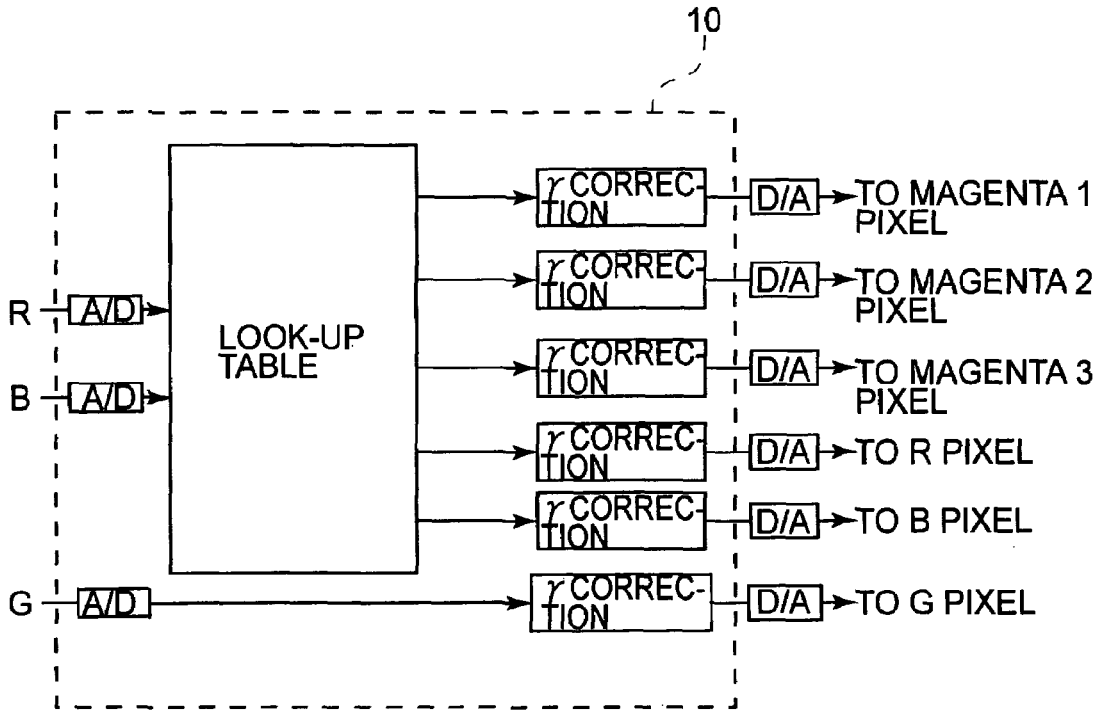
FIG. 21 is a block diagram of a color display system in the above-described Embodiment 5.

In this case, an example of a display system when RGB signals are inputted as input image signals is shown in FIG. 21. In this figure, an example of a system in which input/output means provided with a look-up table is used is shown as the example of the display system. Incidentally, with respect to preparation of the look-up table, on the basis of the full-color display principle, it is possible to correlate the input image signal with the output information.

Further, by making reference to this look-up table in the input/output means 10, display colors outputted to the three magenta subpixels provided with the magenta color filter and/or the subpixels provided with the red or blue color filter are determined. Further, this display colors are, after the gamma correction is finally performed depending on the characteristic of the display device, D/A-converted and supplied as source signals corresponding to the magenta subpixel, the red subpixel, and the blue subpixel of the liquid crystal display device.

Incidentally, a display color outputted to the green subpixel is D/A-converted after the input image signal is subjected to the gamma correction, so that it is supplied as a source signal corresponding to the green subpixel of the liquid crystal display device. Incidentally, with respect to, e.g., the case where the display color can only be outputted as a signal having a smaller number of bits than are in the input image signal from the viewpoint of constraints of driver IC, etc., as an image signal to be outputted to the green subpixel, it is possible to effect the output so as to provide a natural image by the number of gradation levels of green through the dithering according to the known method.

As described above, with respect to the input RGB signals, by using the display system capable of supplying the output signals to the green subpixel and the output signals to the display colors other than green, it becomes possible to display a natural image in the display device capable of effecting the three primary color display in this embodiment.

Embodiment 6

Figure 22:
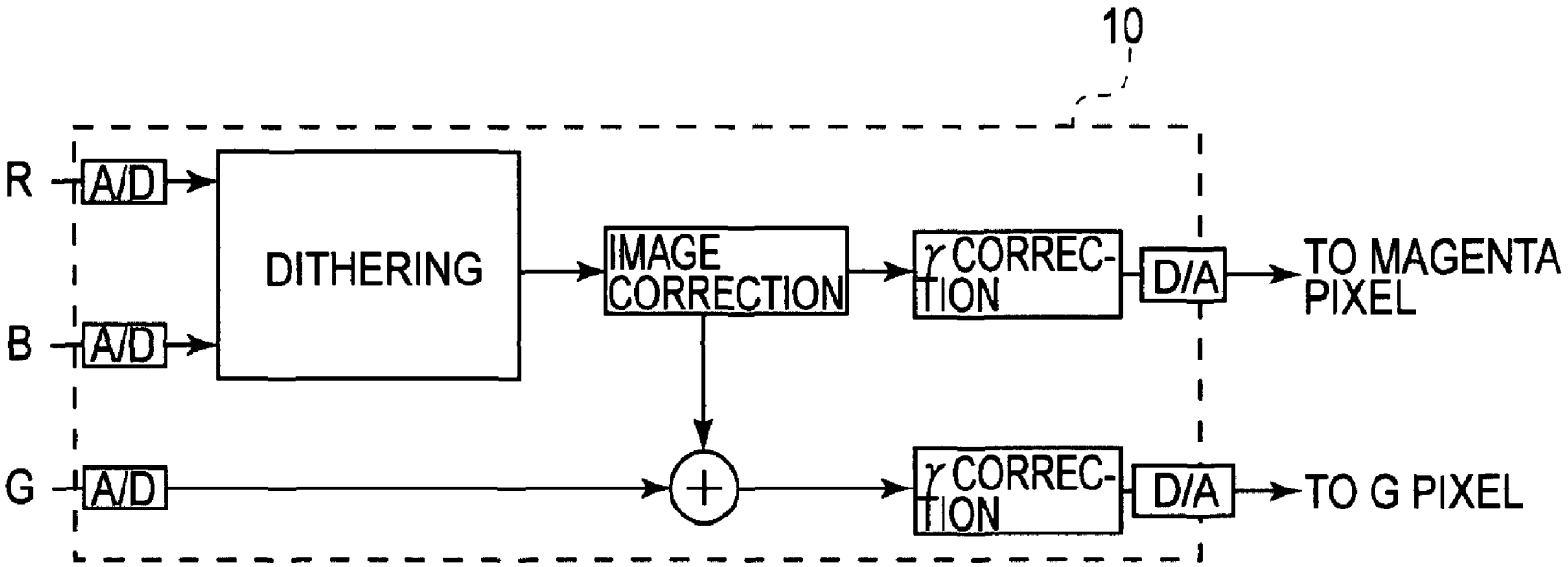
FIG. 22 is a block diagram of a color display system in the above-described Embodiment 6 according to the above described best mode.
Figure 23:
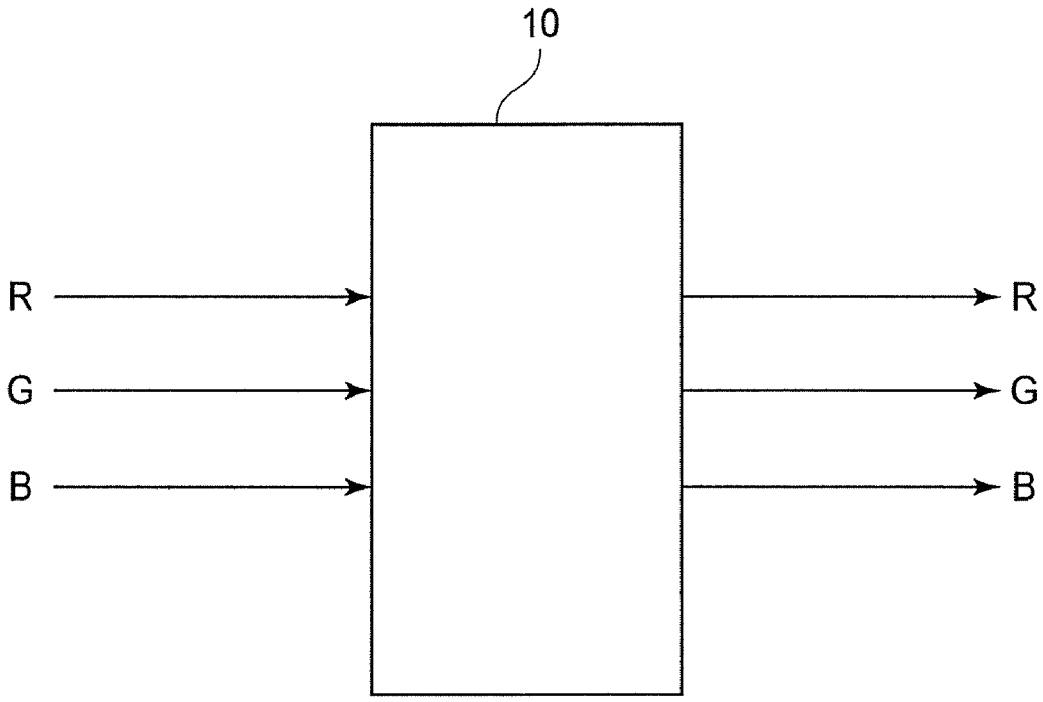
FIG. 23 is a view showing a concept of a color display system used in a conventional color display device.

In the above described embodiments 2-4, the output information to the green pixel is determined completely independent from red and blue, but in this embodiment 6, those in which information of red and blue is reflected are outputted to the green pixel. An example of a system providing such display information is shown in FIG. 22. In this embodiment, the same liquid crystal display device as in embodiment 2 is used.

For example, in such a case where a natural image is obtained by adjusting a color purity (processing hue information) for each gradation amount (gradation information) in order to represent magenta gradation, the gradation amount of magenta is added to (or subtracted from) output information about the green pixel by appropriately checking it in an image correction block, whereby it is possible to obtain the natural image.

In this manner, the output information to the green pixel is not determined from the input image signal alone, but rather it becomes possible to display the natural image in the display device capable of effecting display of the three primary colors in this embodiment by using a display system capable of supplying an output signal for the green subpixel and output signals for display colors other than green with respect to input RGB signals. Incidentally, with respect to this embodiment, the case where the magenta subpixel is divided into a plurality of subpixels can be realized by the same concept, as well.

As described above, by the system of this embodiment, it becomes possible to supply an appropriate output signal to a novel color display device realized by a concept different from the above described already-existing display device for displaying full-color information by outputting RGB information.

Further, in the above embodiments, the vertical alignment mode liquid crystal display device is principally described, but the present invention is applicable to any mode so long as it is a mode that utilizes a change in retardation under voltage application, such as a homogeneous alignment mode, a HAN mode, an OCB mode, or the like. It is also possible to apply the present invention to an alignment mode in which liquid crystal molecules are placed in a twisted alignment state, as in an STN mode. Further, in the above-described embodiments, the reflection-type display device is principally described, but it is easy for the person skilled in the art to apply those of a transmission-type or a transflective-type.

Incidentally, in these embodiments, the gamma correction is performed at an output stage, but it is possible to effect a proper display without performing the gamma correction in a case where the gradation information to be treated and the output characteristic of the display device are consistent with each other.

Alternatively, gamma correction may also be performed after the D/A conversion. In this case, the driver IC may be provided with a gamma correction function therein. Further, by using the polysilicon TFT substrate, these system and other constitutional elements may also be integrally formed on a glass plate. In the case where a display device whose characteristic is changed depending on the temperature at the time of this gamma correction, the D/A processing, or the like, it is preferable that the system is constructed by including a temperature compensation control.

Further, in these embodiments, the TFT substrate is used, so that the D/A conversion processing is performed in all the embodiments but the digital signal may also be outputted as it is without effecting the D/A conversion in the case of effecting gradation display by performing pulse width modulation with the use of an MIM substrate or the like.

A similar effect to those obtained using these embodiments can be attained even in the case where a mode of changing a gap distance being an air (layer) thickness as a medium for an interference layer by a mechanical modulation instead of the liquid crystal display device having the ECB effect. Further, as the display apparatus, the same effect as in these embodiments can also be attained even in the case of using a particle movement-type display device in which the plurality of particles which are a medium on the basis of the constitution described in the embodiments are moved by voltage application.

Further, in the foregoing embodiments, the combination of green and magenta is described as the color filter, but the embodiments are also applicable to combinations of red and cyan and of blue and yellow.

Further, in those embodiments, the TFT (substrate) is used as the drive substrate but a change in substrate constitution such that MIM is used instead of TFT or a switching device formed on a semiconductor substrate is used or a modification of the drive method such that a simple matrix drive or a plasma addressing drive is employed.

Further, as the substrate used in the case of forming the TFT (substrate), any substrate, such as an amorphous silicon TFT substrate, a low-temperature polysilicon TFT substrate, a high-temperature polysilicon TFT substrate, a semiconductor substrate (LCOS), or an active substrate obtained by transferring a semiconductor layer onto a glass or plastic substrate may be used.

As described hereinabove, according to the display apparatus of the present invention, a first output signal for displaying one predetermined color by processing three types of image signals, viz., red, green and blue, and second output signals for displaying two other colors are generated and these first output signal and second output signals are outputted to a display device which effects color display, whereby it becomes possible to effect natural picture display without using three independent color output signals.

What is claimed is:

1. A display apparatus effecting color display depending on three image signals for three colors including first, second and third colors of which the first color corresponds to a color of a color filter, the display apparatus comprising:

a display portion having a display medium constructed to modify brightness and hue of an incident light depending on a display signal applied to the display medium, the display portion including a plurality of pixels each of which is constituted by first and second subpixels of which the first subpixel has the color filter of the first color among the three colors and emits light of the first color and of which the second subpixel emits light of the second and third colors; and a control portion generating a first display signal and a second display signal by using the three image signals for the three colors, wherein the first display signal is generated by using the image signal for the first color of the color filter and is sent to the display portion for determining a brightness of the emitting light of the first subpixel, and wherein the second display signal is generated by using the image signals for the second and third colors and is sent to the display portion for determining a hue of the emitting light of the second subpixel.

2. A display apparatus according to claim 1, wherein the first display signal is the image signal corresponding to the first color of the color filter subtracted by a minimum of the three image signals, and wherein the second display signal is determined from a maximum among the minimum of the three image signals and the signals corresponding to the second and third colors subtracted by the minimum of the three image signals.

3. A display apparatus according to claim 2, wherein the second display signal is an extreme value of the image signals and the difference of the maximum and the extreme value is assigned to the second display signal of adjacent pixels.

4. A display apparatus according to claim 1, wherein the control portion comprises at least one of circuits for: A/D or D/A conversion, image processing, and gamma correction.

5. A display apparatus according to claim 1, wherein the first color is green and the second and third colors are red and blue.

* * * * *